US011175615B2

(12) United States Patent
Shinji et al.

(10) Patent No.: US 11,175,615 B2
(45) Date of Patent: Nov. 16, 2021

(54) IMAGE FORMING APPARATUS, IMAGE FORMING METHOD, AND COMPUTER READABLE STORAGE MEDIUM STORING PROGRAM CAPABLE OF SETTING A TARGET TEMPERATURE FOR A PAGE FOR WHICH IMAGE INFORMATION IS NOT ACQUIRED

(71) Applicant: CANON KABUSHIKI KAISHA, Tokyo (JP)

(72) Inventors: Takeshi Shinji, Kanagawa (JP); Satoshi Nishida, Kanagawas (JP); Isamu Takeda, Tokyo (JP); Takanori Mitani, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/132,087

(22) Filed: Dec. 23, 2020

(65) Prior Publication Data

US 2021/0208525 A1 Jul. 8, 2021

(30) Foreign Application Priority Data

Dec. 27, 2019 (JP) ..... JP2019-238505

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
USPC ..... 399/69
See application file for complete search history.

(56) References Cited

U.S. PATENT DOCUMENTS

| | | | | |
|---|---|---|---|---|
| 8,655,214 | B2 | 2/2014 | Sugiyama et al. | |
| 8,849,142 | B2 | 9/2014 | Sugiyama et al. | |
| 9,014,586 | B2 * | 4/2015 | Ooyanagi ..... | G03G 15/2039 399/69 |
| 9,195,187 | B2 * | 11/2015 | Kan et al. ..... | G03G 15/2039 |
| 9,310,727 | B2 * | 4/2016 | Masumoto et al. ..... | G03G 15/2039 |
| 2012/0315060 | A1 | 12/2012 | Sugiyama et al. | |

(Continued)

FOREIGN PATENT DOCUMENTS

| | | | |
|---|---|---|---|
| JP | 2012-118496 | A | 6/2012 |
| JP | 2012-242752 | A | 12/2012 |

(Continued)

*Primary Examiner* — William J Royer
(74) *Attorney, Agent, or Firm* — Venable LLP

(57) ABSTRACT

An image forming apparatus includes: an acquiring portion configured to acquire image information and operation information of the image forming apparatus; an image forming portion configured to form a toner image on a recording material; a fixing portion configured to fix the toner image to the recording material by heating the recording material on which the toner image is formed; and a control portion configured to, when the acquiring portion acquires image information corresponding to a first page and fails to acquire image information corresponding to a second page following the first page, set a temperature of the fixing portion for fixing the first page as a first temperature based on the image information corresponding to the first page and the operation information, and set the temperature of the fixing portion for fixing the second page as a second temperature based on the operation information.

17 Claims, 19 Drawing Sheets

(56) References Cited

U.S. PATENT DOCUMENTS

| | | | |
|---|---|---|---|
| 2014/0153950 | A1 | 6/2014 | Kan et al. |
| 2020/0371459 | A1 | 11/2020 | Takeda et al. |

FOREIGN PATENT DOCUMENTS

| | | | |
|---|---|---|---|
| JP | 2014-056036 | A | 3/2014 |
| JP | 2014-109716 | A | 6/2014 |

* cited by examiner

| | IMAGE 1 | IMAGE 2 | IMAGE 3 | IMAGE 4 |
|---|---|---|---|---|
| IMAGE |  |  |  |  |
| CONTINUITY C THRESHOLD DETERMINATION | NO | YES | NO | YES |
| COVERAGE RATIO R THRESHOLD DETERMINATION | NO | NO | YES | YES |
| IMAGE TYPE | 1 | 2 | 2 | 2 |

IMAGE FORMING APPARATUS, IMAGE FORMING METHOD, AND COMPUTER READABLE STORAGE MEDIUM STORING PROGRAM CAPABLE OF SETTING A TARGET TEMPERATURE FOR A PAGE FOR WHICH IMAGE INFORMATION IS NOT ACQUIRED

BACKGROUND OF THE INVENTION

Field of the Invention

The present invention relates to an image forming apparatus including a thermal fixing apparatus, such as a printer or a copier, an image-forming method, and a program.

Description of the Related Art

An electrophotographic image forming apparatus, such as a printer or a copier, includes a thermal fixing apparatus (fixing apparatus) for thermally fixing a toner image formed on paper. A known method determines the fixability of an image based on the image information to control the target temperature (fixing temperature). Japanese Patent Application Publication No. 2012-242752 and Japanese Patent Application Publication No. 2014-109716 describe related techniques.

SUMMARY OF THE INVENTION

However, there is the issue of how to set a target temperature for a page for which image information is not acquired and thus unknown. When image information is not acquired, the image may be fixed assuming that the image is most difficult to fix. In this case, a target temperature that is excessively higher than the necessary target temperature may be set for the page with unknown image information. When the target temperature for a page before the page with unknown image information is set based on the target temperature of the page with unknown image information, a high target temperature may be set also for this prior page.

To solve the problem described above, it is an objective of the present invention to provide a process of setting an appropriate target temperature for a page that precedes a page with unknown image information.

In order to achieve the object described above, an image forming apparatus including:

an acquiring portion configured to acquire image information and operation information of the image forming apparatus;

an image forming portion configured to form a toner image on a recording material;

a fixing portion configured to fix the toner image to the recording material by heating the recording material on which the toner image is formed; and a control portion configured to, when the acquiring portion acquires image information corresponding to a first page and fails to acquire image information corresponding to a second page following the first page, set a temperature of the fixing portion for fixing the first page as a first temperature based on the image information corresponding to the first page and the operation information, and set the temperature of the fixing portion for fixing the second page as a second temperature based on the operation information.

In order to achieve the object described above, an image-forming method of an image forming apparatus including an image forming portion that forms a toner image on a recording material and a fixing portion that fixes the toner image to the recording material by heating the recording material on which the toner image is formed, the image-forming method causing a computer to execute:

a step of acquiring image information and operation information of the image forming apparatus; and a step of setting, when image information corresponding to a first page is acquired and image information corresponding to a second page following the first page is not acquired, a temperature of the fixing portion for fixing the first page as a first temperature based on the image information corresponding to the first page and the operation information, and setting the temperature of the fixing portion for fixing the second page as a second temperature based on the operation information.

According to the present invention, an appropriate target temperature is set for a page that precedes a page with unknown image information. Further features of the present invention will become apparent from the following description of exemplary embodiments with reference to the attached drawings.

DESCRIPTION OF THE EMBODIMENTS

Hereinafter, embodiments of the present invention will be described in detail with reference to the drawings. However, it is to be understood that dimensions, materials, shapes, relative arrangements, and the like of components described in the embodiments are intended to be changed as deemed appropriate in accordance with configurations and various conditions of apparatuses to which the present invention is to be applied and are not intended to limit the scope of the present invention to the embodiments described below.

First Embodiment

Figure 1:
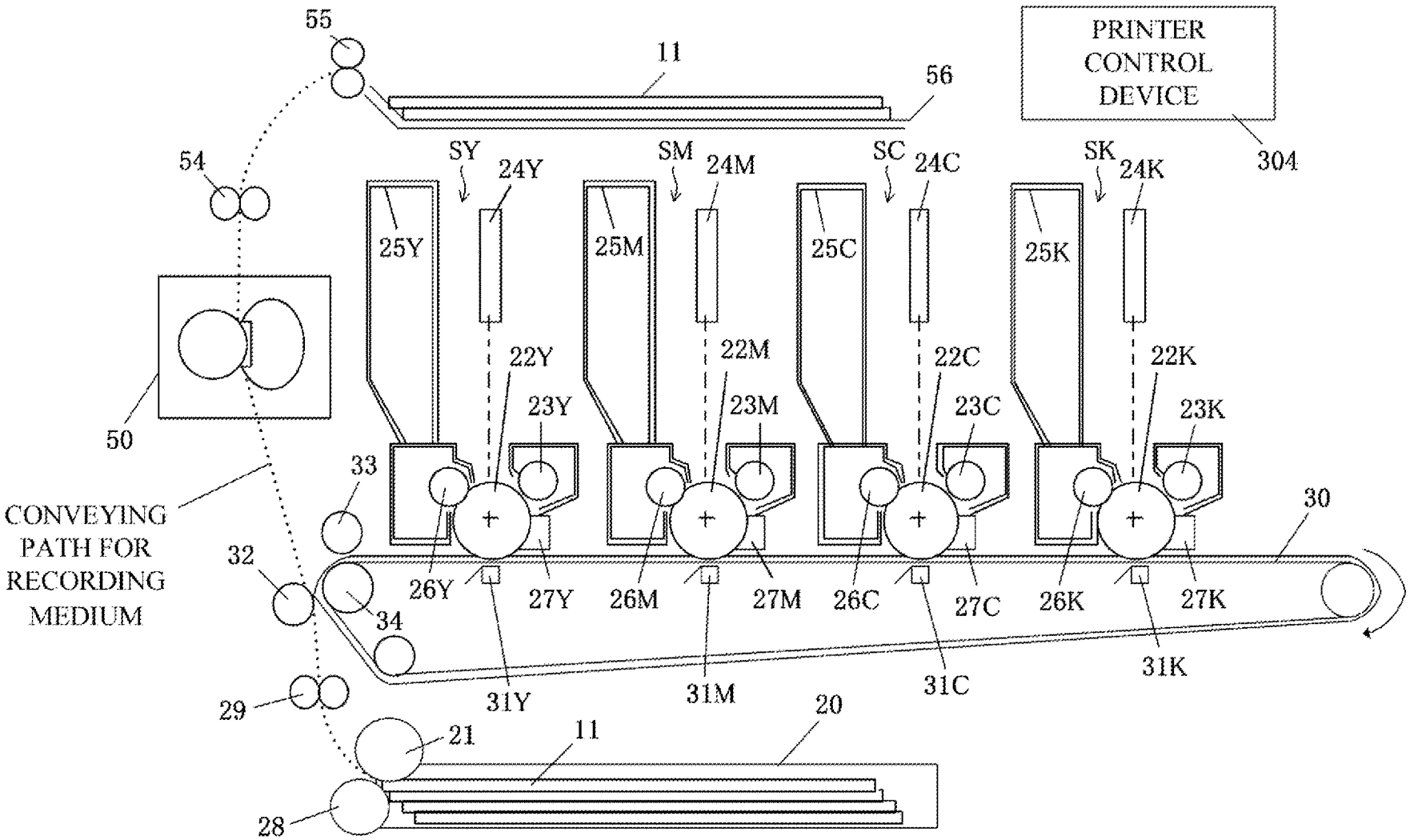
FIG. 1 is a diagram illustrating the configuration of an image forming apparatus of a first embodiment.

The first embodiment is now described referring to FIGS. 1 to 10B. FIG. 1 is a diagram illustrating the configuration of an in-line color image forming apparatus, which is an example of an electrophotographic image forming apparatus. Referring to FIG. 1, the operation of the electrophotographic color image forming apparatus (hereinafter referred to as an image forming apparatus) is described.

The image forming apparatus includes a paper feed portion 20, photosensitive members (hereinafter referred to as photosensitive drums) 22 (22Y, 22M, 22C, and 22K) for the respective stations of colors for development (SY, SM, SC, and SK), and charging devices 23 (23Y, 23M, 23C, and 23K). The image forming apparatus also includes toner cartridges 25 (25Y, 25M, 25C, and 25K) and developing devices 26 (26Y, 26M, 26C, and 26K). The image forming apparatus further includes an intermediate transfer member 30, primary transfer means 31 (31Y, 31M, 31C, and 31K), secondary transfer means (secondary transfer roller) 32, residual toner charging means 33, roller 34 and a fixing portion (thermal fixing apparatus) 50.

Based on an image signal, a printer control device 304 controls exposure by which electrostatic latent images are formed on the photosensitive drums 22. The electrostatic latent images are developed to form monochromatic toner images on the photosensitive drums 22. The monochromatic toner images are superimposed to form a multicolor toner image, which is transferred to a recording medium (recording material) 11. The fixing portion 50 applies heat and pressure to the recording medium 11, fixing the multicolor toner image to the recording medium 11.

Each photosensitive drum 22 is formed by applying an organic optical transmission layer to the outer circumference of an aluminum cylinder. A driving force of a drive motor (not shown) is transmitted to and rotates the photosensitive drums 22 in a counterclockwise direction. The image forming apparatus includes, as charging means, four charging devices 23Y, 23M, 23C, and 23K for charging the yellow (Y), magenta (M), cyan (C), and black (K) photosensitive drums 22 at the respective stations. Laser scanners 24 (24Y, 24M, 24C, and 24K) emit laser beams so that the surfaces of the photosensitive drums 22 are selectively exposed, thereby forming electrostatic latent images on the photosensitive drums 22.

To visualize the electrostatic latent images on the photosensitive drums 22, the image forming apparatus includes four developing devices (developing means) 26Y, 26M, 26C, and 26K to develop yellow (Y), magenta (M), cyan (C), and black (K) at the respective stations. The developing devices 26Y, 26M, 26C, and 26K are configured to be moved toward and away from the photosensitive drums 22Y, 22M, 22C, and 22K by a separation mechanism (not shown).

The intermediate transfer member 30, which may be an endless belt made of resin, is in contact with the photosensitive drums 22 and rotated in a clockwise direction by a drive motor (not shown). The intermediate transfer member 30 rotates with the rotation of the photosensitive drums 22 in image forming operation, and monochromatic toner images are sequentially transferred to the intermediate transfer member 30 when voltages are applied to the primary transfer means 31 (primary transfer). Cleaning means 27 (27Y, 27M, 27C, and 27K) provided on the photosensitive drums 22 retrieve the transfer residual toner remaining on the photosensitive drums 22.

The recording medium 11 placed in advance in the paper feed portion 20 is fed by a paper feed roller 21 and a retard roller 28, and is held and conveyed by resist rollers 29. Then, the intermediate transfer member 30 and secondary transfer means 32, which is in contact with the intermediate transfer member 30, hold and convey the recording medium 11. Applying a voltage to the secondary transfer means 32 transfers the multicolor toner image on the intermediate transfer member 30 to the recording medium 11 (secondary transfer). The configuration for forming a toner image on the recording medium 11 described above is referred to as an image forming portion, which forms a toner image on the recording medium 11 according to the image (image data) in image information. The image forming portion of the image forming apparatus includes the photosensitive drums 22 as image carriers, the charging devices 23 as charging portions, the laser scanners 24 as exposure portions, the developing devices 26 as developing portions, and the intermediate transfer member 30 as a transfer portion.

The image forming apparatus of the present embodiment has two image forming modes, a color mode for forming full-color images and a monochrome mode for forming black monochromatic images. That is, the image forming apparatus can be set to two types of image forming modes, the color mode (mixed color mode), which serves as a first image forming mode, and the monochrome mode (single color mode), which serves as a second image forming mode. The color mode is a mode for forming color toner images on the recording medium 11, and the monochrome mode is a mode for forming monochrome toner images on the recording medium 11. The color mode is the first image forming mode relating to the image forming operation of the image forming apparatus (the operation of the image forming portion), and the monochrome mode is the second image forming mode relating to the image forming operation of the image forming apparatus (the operation of the image forming portion).

The color mode forms images using the yellow (Y), magenta (M), cyan (C), and black (K) developing devices 26Y, 26M, 26C, and 26K. To form images in the color mode, the developing devices 26Y, 26M, 26C, 26K are brought into contact with the photosensitive drums 22Y, 22M, 22C, and 22K. The monochrome mode uses only the developing device 26K to form images. To form images in the monochrome mode, the developing device 26K is brought into contact with the photosensitive drum 22K.

Separating the developing devices 26Y, 26M, and 26C from the photosensitive drums 22Y, 22M, and 22C in the monochrome mode limits the deterioration of the toner in the developing devices 26Y, 26M, and 26C. This also limits the wear of the photosensitive drums 22Y, 22M, and 22C, which would occur due to the sliding friction between the developing devices 26Y, 26M, and 26C and the photosensitive drums 22Y, 22M, and 22C.

The residual toner charging means 33 charges the toner remaining on the intermediate transfer member 30. After a multicolor toner image is transferred to the recording medium 11, the residual toner charging means 33 causes the residual toner on the intermediate transfer member 30 to be charged with a polarity opposite to its original polarity. Then, the residual toner is electrostatically retrieved on the photosensitive drums 22 by the primary transfer means 31, and then retrieved by the cleaning means 27. The fixing portion 50 fuses and fixes the multicolor toner image transferred to the recording medium 11 while holding and conveying the recording medium 11. The details of the fixing portion 50 will be described below. Paper discharge rollers 54 and 55 discharge, to a discharge tray 56, the recording medium 11 to which the toner image is fixed, completing the image forming operation.

Figure 2A:
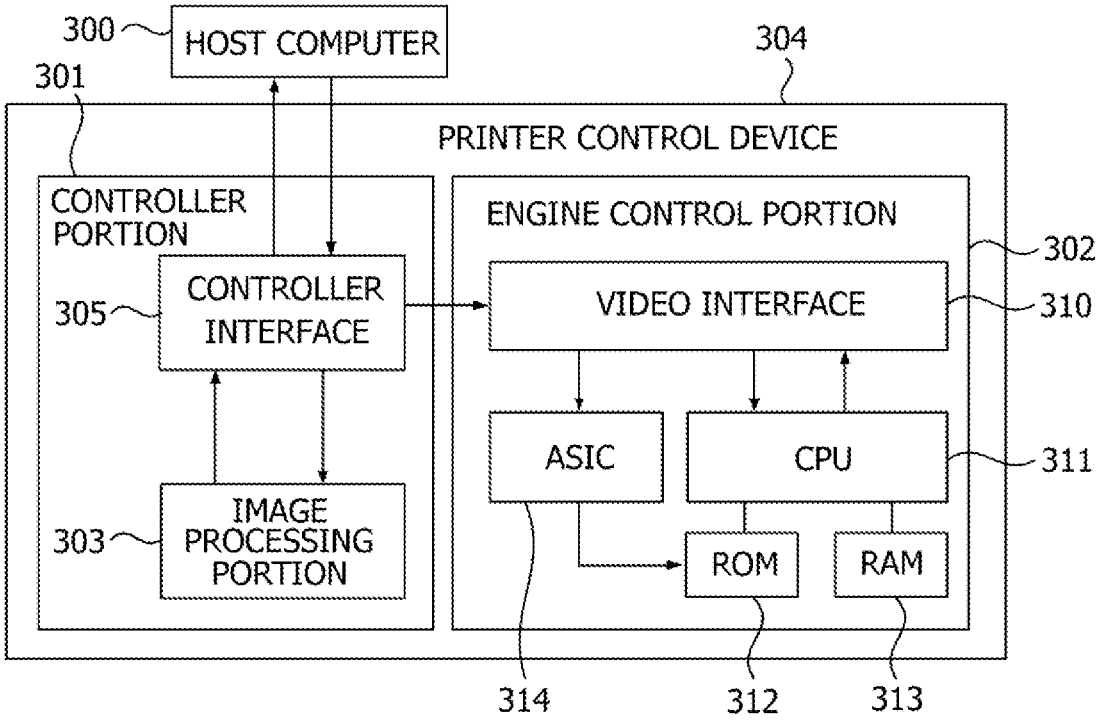
FIG. 2A is a diagram illustrating the configuration of a printer system of the first embodiment.

Referring to FIG. 2A, the printer control device 304 of the first embodiment is now described.

FIG. 2A is a diagram illustrating the configuration of a printer system (image forming system) of the present embodiment. The printer control device 304 is incorporated in an image forming apparatus, which communicates with a host computer 300. The host computer 300 may be a server or a personal computer on a network such as the Internet or a local area network (LAN), or a personal digital assistant such as a smartphone or a tablet terminal. The printer control device 304 connects to and communicates with the host computer 300 via a controller interface 305.

The printer control device 304 is generally divided into a controller portion 301 and an engine control portion 302. The controller portion 301 includes an image processing portion 303 and the controller interface 305. Based on the image information received from the host computer 300 via the controller interface 305, the image processing portion 303 performs processing such as bitmapping of character codes and halftoning of images through dithering. Further, the image processing portion 303 transmits image information to a video interface 310 of the engine control portion 302 via the controller interface 305. This image information includes information for controlling the illumination timing of the laser scanners 24, a print mode for controlling process conditions such as transfer bias, and image size information.

The controller portion 301 transmits the information on the illumination timing of the laser scanners 24 to an application-specific integrated circuit (ASIC) 314. The ASIC 314 controls a part of the image forming portion, such as the laser scanners 24.

Information such as the print mode and the image size is transmitted to a central processing unit (CPU) 311. The CPU 311 is also referred to as a processor. The CPU 311 is not limited to a single processor and may have a multiprocessor configuration. As required, the CPU 311 stores information in a RAM 313, uses a program stored in a ROM 312 or the RAM 313, refers to the information stored in the ROM 312 or the RAM 313, and performs other operations. The CPU 311 uses the ROM 312 and the RAM 313 to perform various controls of the engine control portion 302. The controller portion 301 also controls operations including starting and stopping of a printing operation by sending instructions, such as a print command and a cancellation instruction, to the engine control portion 302 in response to instructions given by the user on the host computer 300. The user can select an image forming mode via the host computer 300. For example, the user can select the color mode or the monochrome mode via the host computer 300. The controller portion 301 transmits information on the image forming mode selected by the user via the host computer 300 to the engine control portion 302. When the color mode is set for the image forming apparatus, the controller portion 301 transmits information indicating that the color mode is set for the image forming apparatus (color mode setting information) to the engine control portion 302. When the monochrome mode is set for the image forming apparatus, the controller portion 301 transmits information indicating that the monochrome mode is set for the image forming apparatus (monochrome mode setting information) to the engine control portion 302.

Figure 2B:
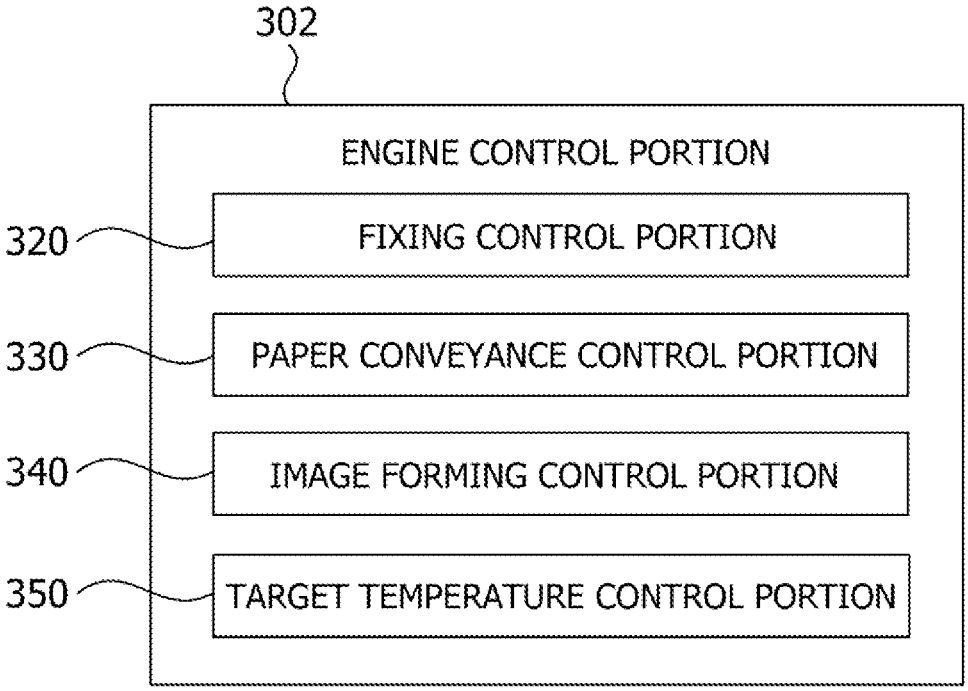
FIG. 2B is a diagram illustrating an example of functional portions of an engine control portion of the first embodiment.

FIG. 2B is a diagram illustrating an example of functional portions of the engine control portion 302. As shown in FIG. 2B, the engine control portion 302 includes a fixing control portion 320, a paper conveyance control portion 330, an image forming control portion 340, and a target temperature control portion 350. When the CPU 311 performs various controls of the engine control portion 302, the engine control portion 302 functions as the portions shown in FIG. 2B. The fixing control portion 320 controls the temperature of the fixing portion 50. The paper conveyance control portion 330 controls the operation interval of the paper feed portion 20. The image forming control portion 340 performs operations such as process speed control, development control, charge control, and transfer control. The image forming control portion 340 acquires operation information of the image forming apparatus, such as a print command, a cancellation instruction, color mode setting information, and monochrome mode setting information, sent from the host computer 300. The target temperature control portion 350 may determine, change, and set target temperatures. The host computer 300 or a server on a network may perform a part of the processes performed by the image forming apparatus. The host computer 300 or a server on a network may perform a part or all of the processes performed by the engine control portion 302 and the image processing portion 303. The host computer 300 and a server on a network are examples of processing units. Further, the image processing portion 303 may perform a part or all of the processes performed by the engine control portion 302, or the engine control portion 302 may perform a part or all of the processes performed by the image processing portion 303.

Fixing Portion

Figure 3:
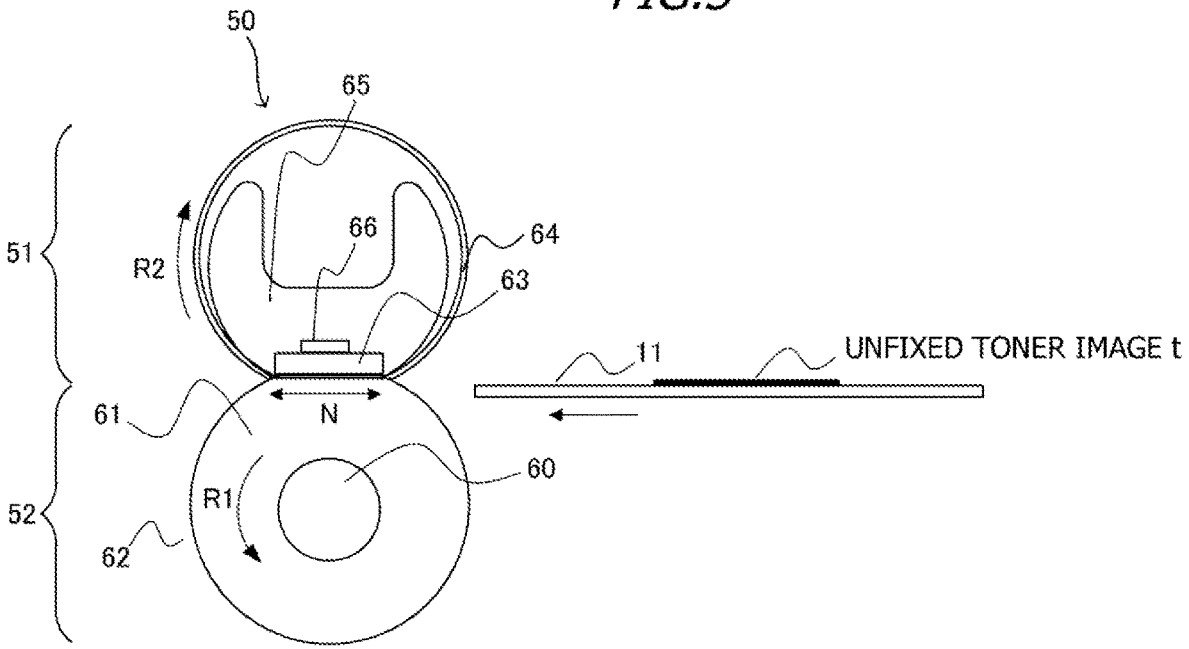
FIG. 3 is a cross-sectional view illustrating the configuration of a fixing portion of the first embodiment.

Referring to FIG. 3, the film-heating fixing portion 50 of the present embodiment is now described. The fixing portion 50 includes a film unit 51 as a heating device and a pressure roller 52.

The film unit 51 includes a fixing film 64 as a fixing member, a heater 63 as a heating member, and a heater holder 65 as a heater holding member. The fixing film 64 is a cylindrical rotating member. The pressure roller 52 as a pressure member faces the film unit 51. The pressure roller 52 is an elastic rotating member.

The fixing portion 50 holds and conveys the recording medium 11 on which an unfixed toner image t is formed in a pressure contact nip (fixing nip) N, which is formed by the heater 63 and the pressure roller 52 with the fixing film 64 in between. The toner image t is thus fixed to the recording medium 11. That is, the fixing portion 50 heats the recording medium 11 on which the toner image t is formed while conveying the recording medium 11 in the nip N, thereby fixing the toner image t to the recording medium 11.

Heater

As shown in FIG. 3, the heater 63 is arranged inside the fixing film 64. The heater 63 may be a ceramic heater. The heater 63 includes a ceramic substrate, which may be made of alumina, and a resistance heating layer, which may be made of silver-palladium alloy, formed on the ceramic substrate. The resistance heating layer of the heater 63 is covered with a glass overcoat for the insulation and wear resistance of the resistance heating layer, and the glass overcoat is in contact with the inner circumference surface of the fixing film 64. A small amount of a lubricant, such as heat-resistant grease, is applied to the surface of the heater 63. The fixing film 64 thus rotates smoothly.

A thermistor 66 as a temperature detecting member is placed on the surface of the heater 63 opposite to the surface in sliding contact with the fixing film 64. Based on the temperature detected by the thermistor 66, the fixing control portion 320 controls the current supplied to the heater 63 so at to maintain a desired temperature of the heater 63. In other words, the fixing control portion 320 controls the energization of the heater 63 such that the temperature detected by the thermistor 66 is maintained at a certain target temperature. For example, the fixing control portion 320 controls the current flowing through the heater 63 according to the signal from the thermistor 66, thereby controlling the temperature of the heater 63. The fixing control portion 320 may detect the temperature of the heater 63 as the temperature of the fixing portion 50. The fixing control portion 320 may control the electric power supplied to the fixing portion 50 such that the temperature of the fixing portion 50 is maintained at the target temperature. For example, the fixing control portion 320 may control the temperature of the fixing portion 50 by controlling the current flowing through the fixing portion 50 according to the signal from the thermistor 66. The target temperature control portion 350 may perform a part or all of the processes performed by the fixing control portion 320.

Fixing Film

The fixing film 64 is a multi-layered film including a thin metal tube, which may be made of steel use stainless (SUS), and a release layer, which may be made of PFA, PTFE, or FEP and placed on the surface of the metal tube directly or through a primer layer. The release layer may be coated on the surface or placed as a tube. Instead of the metal tube, a base layer may be used that is formed by kneading and then shaping a heat-resistant resin, such as polyimide, and a heat conductive filler, such as graphite, into a tubular shape. The fixing film 64 of the present embodiment is formed by coating a polyimide base layer with PFA. The fixing film 64 may have a total film thickness of 70 μm and an outer circumference length of 57 mm.

Pressure Roller

The pressure roller 52 includes a core metal 60, which may be made of iron, an elastic layer 61, and a release layer 62. The elastic layer 61 is formed by foaming heat-resistant rubber, such as insulating silicone rubber or fluoro-rubber, on the core metal 60. The elastic layer 61 is primed with adhesive RTV silicone rubber, which serves as an adhesion layer. A material in which a conductive agent, such as carbon, is dispersed in PFA, PTFE, FEP, or the like is formed into a tube and placed over the release layer 62, or the release layer 62 is coated with this material. The release layer 62 is thus formed on the elastic layer 61 through the adhesion layer. The pressure roller 52 of the present embodiment has an outer diameter of 18 mm and a roller hardness of 48° (Asker-C, 600 g weight).

To form the pressure contact nip N required for thermal fixing, the pressure roller 52 is pressed by pressure means (not shown) with a force of 180 N at its longitudinal ends. When the core metal 60 is rotated, the pressure roller 52 is rotated in the direction indicated by Arrow R1 in FIG. 3 (counterclockwise). This drives the fixing film 64 to rotate around the heater holder 65 in the direction indicated by Arrow R2 in FIG. 3 (clockwise).

Heater Holder

The heater holder 65, which holds the heater 63, may be formed of a liquid crystal polymer, a phenol resin, PPS, or PEEK. The fixing film 64 is loosely fitted on the heater holder 65 in a rotational manner.

The recording medium 11 passes through the pressure contact nip N formed between the pressure roller 52 and the fixing film 64. In the pressure contact nip N, the heat from the heater 63 heats the recording medium 11 through the fixing film 64. The heat from the heated fixing film 64 and the pressure in the pressure contact nip N fuse the unfixed toner image t on the recording medium 11 and fix it to the recording medium 11.

The temperature control program stored in the ROM 312 or the RAM 313 causes the engine control portion 302 as control means to maintain the temperature of the heater 63 at the predetermined target temperature based on the temperature detected by the thermistor 66 as the temperature detection portion. The control is preferably PID control with proportional, integral, and derivative terms. The PID control determines the activation time of the heater 63 in each cycle, and drives a heater activation time control circuit (not shown) to determine the power output to the heater 63. The present embodiment updates the power output to the heater 63 at intervals of 100 msec of the control cycle.

The engine control portion 302 or the target temperature control portion 350 determines, sets, or changes target temperatures based on information from the image processing portion 303, which will be described below. The engine control portion 302 or the target temperature control portion 350 gives instructions to the fixing control portion 320 based on the target temperature. In addition to the information from the image processing portion 303, the engine control portion 302 or the target temperature control portion 350 may use other information of conventional correction, such as the degree of warming of the fixing portion 50, the environment temperature and humidity, the print mode, and the type of recording material, to correct the target temperature. The fixing control portion 320 may perform all or a part of the processes performed by the target temperature control portion 350.

Figure 4:
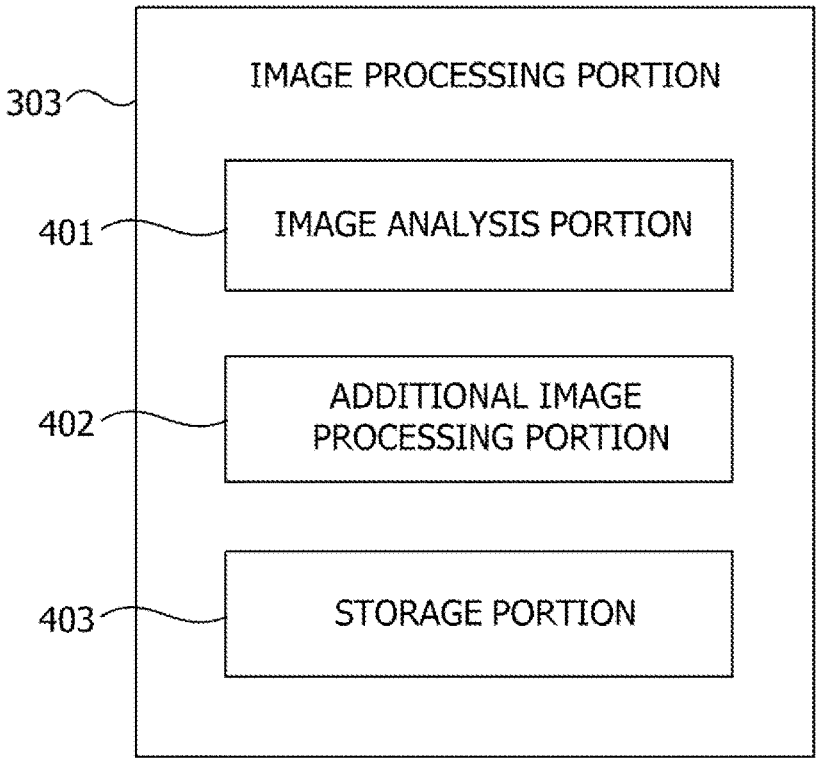
FIG. 4 is a diagram illustrating an example of functional portions of an image processing portion of the first embodiment.

FIG. 4 is a diagram illustrating an example of functional portions of the image processing portion 303. The image processing portion 303 includes an image analysis portion 401 as image analysis means, an additional image processing portion 402, and a storage portion 403. The image analysis portion 401 acquires pages (page data) and the image information on the pages sent from the host computer 300. As will be described below, the image analysis portion 401 calculates the target temperatures required for images to be printed or fixing temperature correlation values that correlate with the required target temperatures. The additional image processing portion 402 performs processing such as image conversion of character codes and halftoning, and bitmaps images. The storage portion 403 stores data and information generated in the processes performed by the image analysis portion 401 and the additional image processing portion 402. The storage portion 403 may be a RAM, for example.

The additional image processing portion 402 of the image forming apparatus of the present embodiment performs processing with a resolution of 600 dpi. However, the additional image processing portion 402 may perform processing with other resolutions. Additionally, the image analysis portion 401 performs calculation processing on the image information after the processing by the additional image processing portion 402 is completed. However, the order of image processing is not limited to this, and the calculation processing can be performed on the image information before the processing by the additional image processing portion 402 is performed.

The target temperatures required for images to be printed vary according to the toner height and the print percentage. In general, a greater toner height increases the amount of toner on the recording medium 11 and thus the amount of heat required to fuse and fix the toner. A greater toner height therefore requires a higher target temperature. Additionally, a continuous toner image, such as a solid image, and a discrete toner image, such as a character image, may require different target temperatures even when they are equal in toner height. A character image is generally easier to fix because a discrete toner image has higher fixing performance increased by the heat coming from the image-free region around the toner image. The target temperature for an image to be printed varies according to the density and shape of the image.

Various methods have been proposed to calculate target temperatures for images. The present embodiment uses a method involving image density information D and image type information I.

The image density information D is density information (density value) of the pixels having the highest density among all pixels in the image information corresponding to a toner image to be formed on the recording medium 11. The pixel density information may be defined in a percentage (%) or a tone value (0 to 255). The image analysis portion 401 stores in the storage portion 403 the image density information D of the first page of multiple recording media 11 that are successively printed, as image density information D1. Further, the image analysis portion 401 determines the image type information I based on the image information by using a method described below. The image analysis portion 401 stores in the storage portion 403 the image type information I of the first page of multiple recording media 11 that are successively printed, as image type information I1. The image analysis portion 401 stores in the storage portion 403 the image density information D of the second page of multiple recording media 11 that are successively printed, as image density information D2. The image analysis portion 401 stores in the storage portion 403 the image type information I of the second page of multiple recording media 11 that are successively printed, as image type information 12. The image analysis portion 401 stores in the storage portion 403 the image density information D of the nth page of multiple recording media 11 that are successively printed, as image density information $D_n$. The image analysis portion 401 stores in the storage portion 403 the image type information I of the nth page of multiple recording media 11 that are successively printed, as image type information $I_n$.

The detection time of the image density information D and the image type information I varies depending on factors including the amount of image information, the processing speed of the host computer 300, the transmission speed from the host computer 300 to the controller portion 301, and the processing speed of the controller portion 301. The number of pieces of image density information D and image type information I stored in the storage portion 403 is therefore not always constant. For the same reason, the numbers of pieces of image density information D and image type information I stored in the RAM 403 are not always the same.

The relationship between the image density information D and the amount of toner on the recording medium 11 is now described. The image density information D correlates with the amount of toner per unit area on the recording medium 11, and relates to the amount of toner in the toner image formed on the recording medium 11. The maximum density of any one of yellow (Y), magenta (M), cyan (C), and black (K) is 100%. In the present embodiment, the maximum value of the density in full color (total value of four colors) is set to 250% in consideration of fixing performance. When the image density information D is 100%, the amount of toner per unit area on the recording medium 11 is about 0.4 mg/cm'. When the image density information D is 250%, the amount of toner per unit area on the recording medium 11 is about 1.0 mg/cm$^2$.

Figure 5:
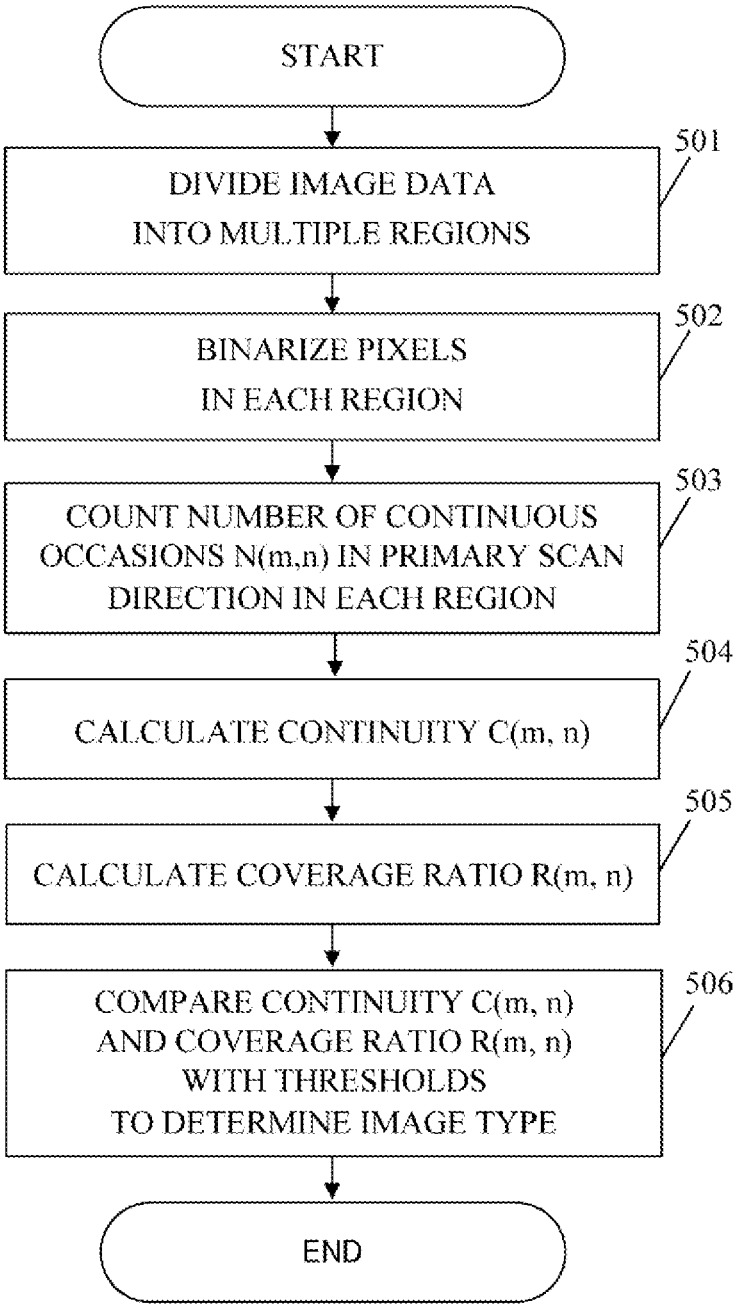
FIG. 5 is a flowchart illustrating a process of the first embodiment.

Referring to FIGS. 5, 6, 7A and 7B, a method for determining the image type information I is now described. FIG. 5 is a flowchart illustrating a method for determining the image type information I. In the following example, printing is performed on each recording medium 11 based on the image information for each page sent from the host computer 300 to the image forming apparatus. The following process is also applicable to print image information for successive n pages (n is an integer of at least 2) on multiple recording media 11. The image type information I indicates whether the image contained in the image information is a solid image or a character image. The present embodiment determines the image type information I based on continuity and coverage ratio. The continuity is a characteristic in which pixels with a predetermined density or higher are continuous in a predetermined region in the image. The coverage ratio is the proportion of pixels with a predetermined density or higher in the predetermined region of the image.

Figure 6:
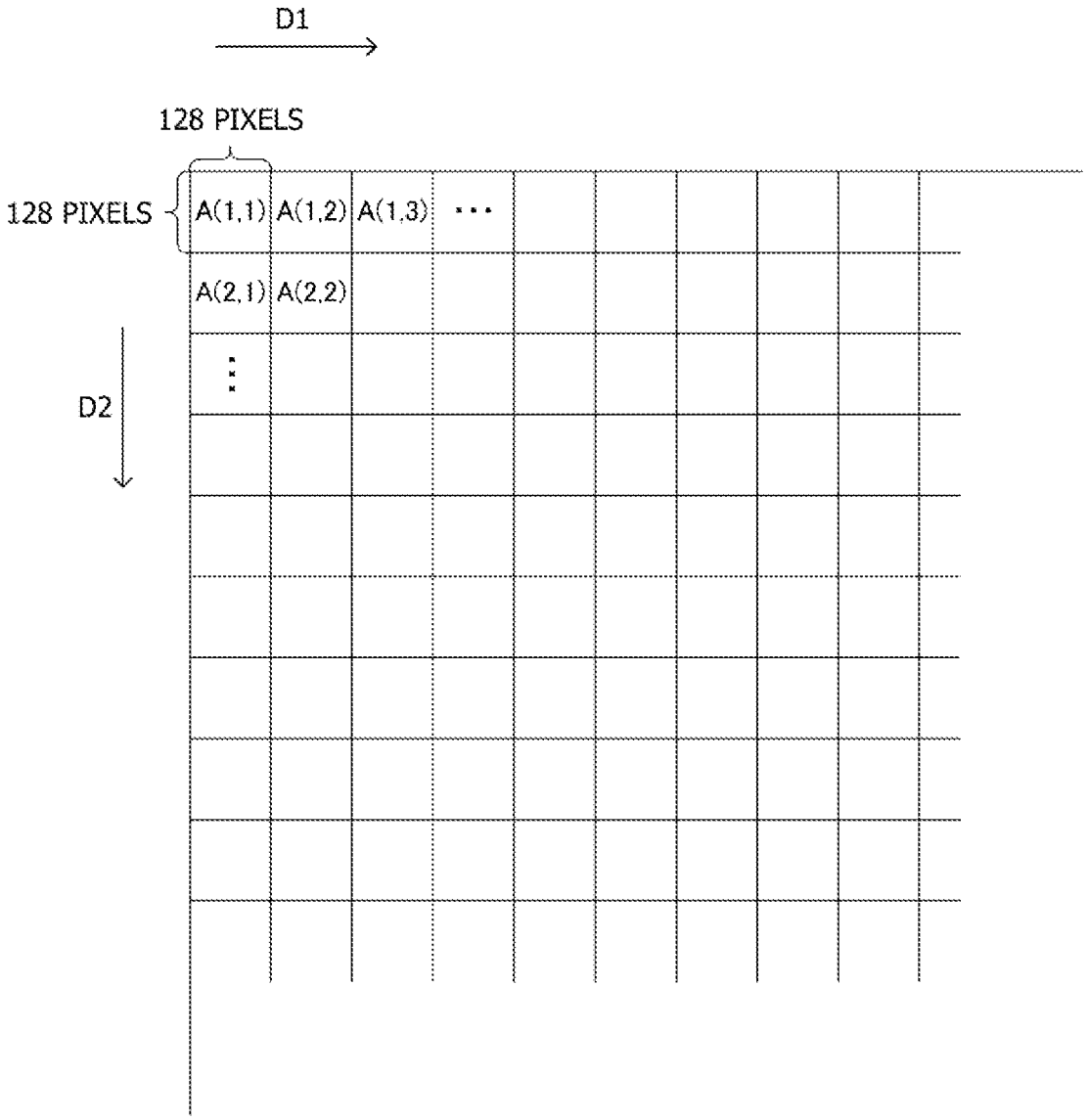
FIG. 6 is a diagram illustrating an image dividing process of the first embodiment.

At Step 501, the image analysis portion 401 divides an image (600 dpi) into square regions of 128 by 128 pixels in a main scanning direction (horizontal direction, direction of Arrow D1) and in a sub scanning direction (vertical direction, direction of Arrow D2) as shown in FIG. 6. That is, the image analysis portion 401 divides the image into multiple regions including multiple pixels. The size of the divided region is preferably about 10 to 2000 pixels. If the regions are too small, a character may be recognized as a solid image. If the regions are too large, a region having both a character and a solid image may be erroneously recognized. The shape of the regions of the present embodiment is square, but other shape (predetermined shape), such as rectangle, may be used. The main scanning direction is perpendicular to the conveying direction of the recording medium 11. The sub scanning direction extends in the conveying direction of the recording medium 11.

As shown in FIG. 6, each of the regions is assigned with A(m, n), where m in the parentheses is its number in the vertical direction (sub scanning direction) in Region A, and n in the parentheses is its number in the horizontal direction (main scanning direction). The m in the parentheses is the number counted from the front end of the recording medium 11, and the n in the parentheses is the number counted from the left end of the recording medium 11. Both m and n are positive integers of at least 1. When the total number of pixels in each region is Pa, Pa of the present embodiment is 128×128, which is 16384.

At Step 502, the image analysis portion 401 binarizes each pixel into 0 and 1, and assigns 0 or 1 to each pixel in each region. The present embodiment assigns a binary value of 0 to a pixel having a density value (density data value) of 0, or a white pixel, and assigns a binary value of 1 to a non-white pixel. Here, the threshold for the binarization of pixels is 0, but other threshold may be used. Further, instead of the binarization with one threshold, the pixels in each region may be classified with multiple thresholds.

Figure 7B:
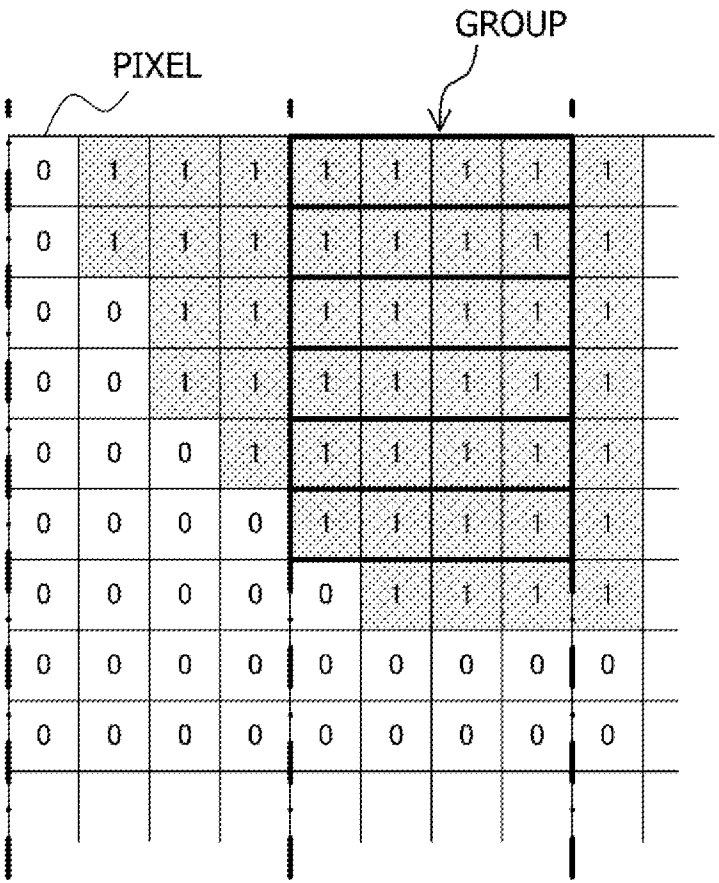
FIGS. 7A and 7B are diagrams illustrating processes of counting the number of continuous occasions of the first embodiment.
Figure 7A:
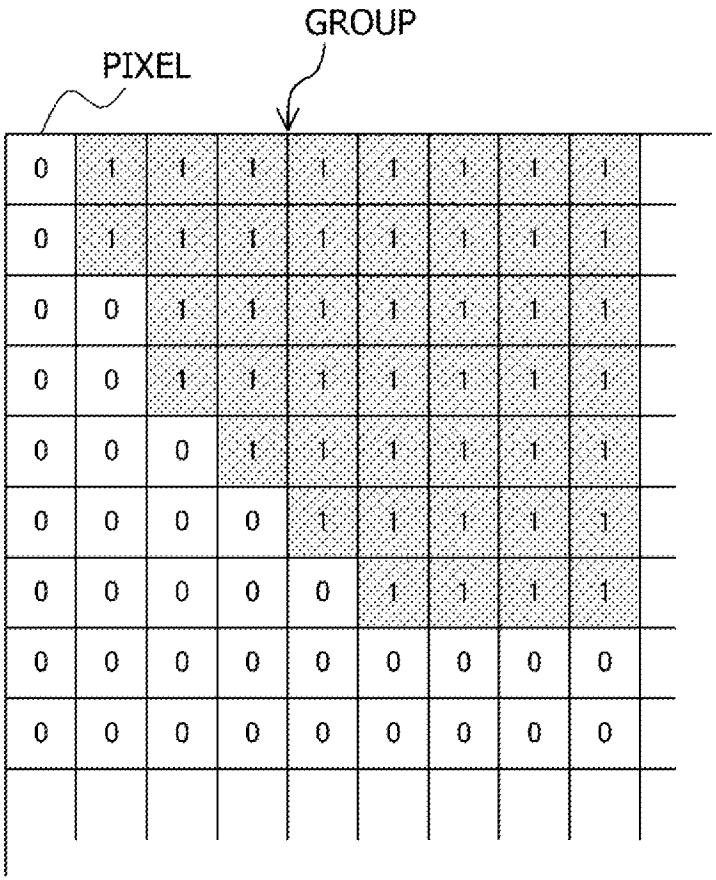

At Step 503, as shown in FIG. 7A, the image analysis portion 401 counts the number N(m,n) of occasions where four pixels with a binary value of 1 are continuously arranged in the main scanning direction in each region (hereinafter also referred to as the number of continuous occasions). In other words, the image analysis portion 401 counts the number of groups each consisting of four pixels (pixels with "1") continuously arranged in the main scanning direction in each region. The number of pixels with a binary value of 1 that are continuously arranged (the number of continuous pixels) in one group is preferably a predetermined number of about 3 to 30. If an image to be determined is too small (the number of pixels is small), it would be difficult to distinguish between a character image and a solid image. If an image to be determined is too large (the number of pixels is large), the image would include a character with a thick line width that is difficult to fix. As shown in FIG. 7B, the number of continuous occasions may be counted by dividing the image into predetermined areas in the main scanning direction and determining whether pixels are continuous in each area. The number of continuous occasions may be counted with either technique depending on other processing conditions.

At Step 504, the image analysis portion 401 calculates the continuity C(m, n) using a number acquired by multiplying the number of continuous occasions N(m, n) counted at Step 503 by 4 as the numerator, and the number of pixels P(m, n) with a binary value of 1 in the region as the denominator. The image analysis portion 401 calculates the continuity C(m, n) for each region.

When P(m, n)=0, C(m, n)=0. The continuity C(m, n) takes a value from 0 to 1.

$$C(m,n)=N(m,n)\times 4/P(m,n)$$

In other words, the continuity C(m, n) is a value (first ratio) acquired by dividing the total number of pixels in multiple groups each consisting of pixels that have a binary value of 1 and are continuously arranged in a predetermined direction in a predetermined region by the total number of pixels that have a binary value of 1 in the predetermined region. That is, the continuity C(m, n) is a value (first ratio) acquired by dividing the total number of pixels that have a binary value of 1 and are continuously arranged in a predetermined direction in a predetermined region by the total number of pixels that have a binary value of 1 in the predetermined region. The predetermined direction may be the main scanning direction. A pixel with a binary value of 1 has a density greater than or equal to a predetermined value. The predetermined value may be a density value other than 0.

At Step 505, the image analysis portion 401 calculates the coverage ratio R(m, n) by using the number of pixels P(m, n) with a binary value of 1 in a region as the numerator, and the number of all pixels Pa in the region as the denominator. The image analysis portion 401 calculates the coverage ratio R(m, n) for each region. The coverage ratio R(m, n) takes a value from 0 to 1.

$$R(m,n)=P(m,n)/Pa$$

That is, the coverage ratio R(m, n) is a value (second ratio) acquired by dividing the total number of pixels with a binary value of 1 in a predetermined region by the total number of pixels in the predetermined region.

At Step 506, the image analysis portion 401 compares the continuity C(m, n) with a continuity threshold Cth and the coverage ratio R(m, n) with a coverage ratio threshold Rth for each region. The image analysis portion 401 determines whether the continuity C(m, n) of a given region is less than the continuity threshold Cth (first threshold). The image analysis portion 401 also determines whether the coverage ratio R(m, n) of this region is less than the coverage ratio threshold Rth (second threshold). When the continuity C(m, n) of a given region is less than the continuity threshold Cth (first threshold) and the coverage ratio R(m, n) of this region is less than the coverage ratio threshold Rth (second threshold), the image analysis portion 401 determines that the region is of Image Type 1. That is, when both the continuity C(m, n) and the coverage ratio R(m, n) of a given region are less than the thresholds, the image analysis portion 401 determines that this region is of Image Type 1. When the continuity C(m, n) of a given region is greater than or equal to the continuity threshold Cth, or when the coverage ratio R(m, n) of the region is greater than or equal to the coverage ratio threshold Rth, the image analysis portion 401 determines that this region is of Image Type 2. That is, when at least one of the continuity C(m, n) and the coverage ratio R(m, n) of a given region is greater than or equal to the threshold, the image analysis portion 401 determines that this region is of Image Type 2. The present embodiment uses a continuity threshold Cth of 0.8 and a coverage ratio threshold Rth of 0.25, but the continuity threshold Cth and the coverage ratio threshold Rth may be other values.

Figure 8:
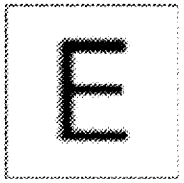
FIG. 8 is a diagram illustrating an image type determination process of the first embodiment.
Figure 8:
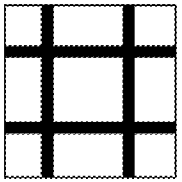
Figure 8:
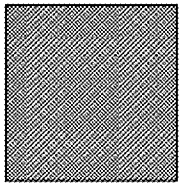
Figure 8:
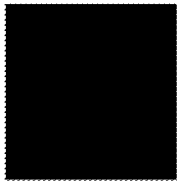

Referring to FIG. 8, the present embodiment determines the image type based on the continuity and coverage ratio as described below. To simplify the description, the examples used here are black monochromatic images.

An image of Image Type 1 is discrete, has a low coverage ratio, and easy to fix, such as a character image. An image of Image Type 2 is continuous and difficult to fix, such as a solid image. Images 1 to 4 in FIG. 8 are now described. Image 1 is an image containing a character in 10.5-point MS P Gothic. The continuity C and the coverage ratio R of Image 1 are both less than the thresholds (threshold determination: NO). The image type information I of Image 1 is thus determined as Image Type 1. Image 2 is a grid image including 0.5 mm wide vertical and horizontal lines. The continuity C of the Image 2 exceeds the threshold (threshold determination: YES), but the coverage ratio R of Image 2 is less than the threshold (threshold determination: NO). The image type information I of Image 2 is thus determined as Image Type 2. Image 3 includes a checkered pattern. The continuity C of Image 3 is 0 and therefore less than the threshold (threshold determination: NO). The coverage ratio R of Image 3 is 0.5 and therefore greater than the threshold (threshold determination: YES). The image type information I of Image 3 is thus determined as Image Type 2. Image 4 is entirely solid. The continuity C and the coverage ratio R of Image 4 are both 1 and therefore greater than the thresholds (threshold determination: YES). The image type information I of Image 4 is thus determined as Image Type 2. These image examples demonstrate that discrete images with low coverage ratios, such as characters, are determined as of Image Type 1.

When the image type information I of all regions in the image of the nth page is Image Type 1, the image of the nth page is determined as including only discrete images with lows coverage ratios, such as character images. The image analysis portion 401 determines the image type information I of the nth page as Image Type 1 when all regions in the image of the nth page are of Image Type 1. The image analysis portion 401 determines that the image type information I of the nth page is Image Type 2 when at least one region in the image of the nth page is of Image Type 2. Alternatively, the image analysis portion 401 may determine that the image type information I of the nth page is Image Type 1 when at least half of the regions in the image of the nth page are of Image Type 1.

The relationship between the toner image on the recording medium 11 and the target temperature is now described. When an insufficient amount of heat is applied to a given toner image, the toner may not be sufficiently fixed to the recording medium 11 and may be peeled off due to faulty fixation. It is thus desirable that the target temperature be adjusted to an optimal value (optimal target temperature) according to the image. The optimal target temperature varies according to the apparatus configuration, process speed, environment, and the recording medium used.

When the amount of toner on the recording medium 11 corresponds to the maximum density of 250%, which is the full-color upper limit of the image forming apparatus (i.e., the toner amount is 1.00 mg/cm$^2$), the fixable temperature for the solid image (image type information $I_n$=2) is defined as a reference fixable temperature Ts. A fixable temperature is set such that the power consumption is minimized without causing faulty fixation when the fixable temperature is used as the target temperature. Tb denotes the fixable temperature for an image of a page with given image density information D and image type information I. When the image density information D of the nth page is the image density information $D_n$ and the image type information I of the nth page is the image type information $I_n$, the fixable temperature $Tb_n$ for the nth page (fixable temperature $Tb_n$) is given by following Expressions 1 and 2.

When the image type of the nth page is character image (image type information $I_n$=1), the fixable temperature $Tb_n$ is given by Expression 1 below.

$$Tb_n = Ts - 60 + (0.2 \times D_n)(100 \leq D_n \leq 250) \quad \text{(Expression 1)}$$

When the image type of the nth page is solid image (image type information $I_n$=2), the fixable temperature $Tb_n$ is given by Expression 2 below.

$$Tb_n = Ts - 50 + (0.2 \times D_n)(100 \leq D_n \leq 250) \quad \text{(Expression 2)}$$

If the image density information $D_n$ of the nth page is less than 100, the calculation is performed by assigning 100(%) to the image density information $D_n$. A full-color image often includes an image of a monochrome character in black, for example, and such a full-color image includes an image with image density information $D_n$ of 100(%). For this reason, in the unlikely event that the image density information $D_n$ is less than 100(%), the calculation is performed supposing that the image density information $D_n$=100(%).

As described above, the fixable temperature $Tb_n$ of the present embodiment linearly relates to the image density information $D_n$. When a character image and a solid image have the same image density, the fixable temperature $Tb_n$ for the character image is 10° C. lower than the fixable temperature $Tb_n$ for the solid image. Thus, when the image of the nth page is a character image, the image can be fixed at a temperature 10° C. lower than that for a solid image.

With Expression 1, $Tb_n$=Ts−40° C. when $D_n$=100, and $Tb_n$=Ts−10° C. when $D_n$=250. With Expression 2, $Tb_n$=Ts−30° C. when $D_n$=100, and $Tb_n$=Ts when $D_n$=250. In the color mode, the lower limit of the image density information $D_n$ is 100% ($D_n$=100), and the upper limit of the image density information $D_n$ is 250% ($D_n$=250). The setting range (temperature range) of the fixable temperature Tb in the color mode is therefore Ts to Ts−40° C. In the monochrome mode, the image density information $D_n$ is 100% ($D_n$=100). The setting range (temperature range) of the fixable temperature Tb in the monochrome mode is therefore Ts−30° C. to Ts−40° C.

For example, when the fixable temperature $Tb_{n+1}$ is significantly higher than the fixable temperature $Tb_n$, the temperature may fail to rise from the fixable temperature $Tb_n$ to the fixable temperature $Tb_{n+1}$ in time and thus cause faulty fixation, or the abrupt temperature rise may excessively fluctuate the temperature during image formation, resulting in an image with non-uniform gloss. For this reason, a temperature rise upper limit L (limit of temperature shift per page) is set between the fixable temperature Tb for the nth page (fixable temperature $Tb_n$) and the fixable temperature Tb for the (n+1)th page (fixable temperature $Tb_{n+1}$). In the present embodiment, the temperature rise upper limit L is 5° C. Nevertheless, faulty fixation and non-uniform gloss do not occur with some types of apparatus configuration, toner, and recording medium 11. In this case, the fixable temperature $Tb_n$ may be calculated without setting the temperature rise upper limit L.

When calculating the fixable temperature Tb for the nth page, the image forming apparatus of the present embodiment acquires the image information corresponding to the nth to (n+3)th pages, that is, the image information for three pages ahead. The acquirement of image information is affected by factors such as processes in the host computer 300, the transmission from the host computer 300 to the controller portion 301, and processes in the controller portion 301. As such, there may be a situation in which the image information corresponding to the (n+3)th page is not acquired and the image information corresponding to the nth to (n+2)th pages is acquired.

The fixable temperatures Tb for the (n+1)th page, the (n+2)th page, the (n+3)th page, the (n+4)th page, . . . , which follow the nth page, are defined as the fixable temperatures $Tb_{n+1}$, $Tb_{n+2}$, $Tb_{n+3}$, $Tb_{n+4}$ . . . . The target temperature for fixing a toner image formed according to the image information corresponding to the nth page to the recording medium 11 is defined as the target temperature $T_n$. The target temperature $T_n$ needs to be set so that the temperature increases from the target temperature $T_n$ to the fixable temperatures $Tb_{n+1}$, $Tb_{n+2}$, $Tb_{n+3}$, $Tb_{n+4}$, . . . by an increment not exceeding the temperature rise upper limit L. To this end, the largest value (the highest temperature) among Temperature 1 to Temperature 5 below is selected as the target temperature $T_n$.

Temperature 1: $Tb_n$
Temperature 2: $Tb_{n+1}$−L
Temperature 3: $Tb_{n+2}$−L×2
Temperature 4: $Tb_{n+3}$−L×3
Temperature 5: $Tb_{n+4}$−L×4

The image information corresponding to the (n+4)th page is not acquired. In consideration of the possibility that the density of the image of the (n+4)th page is the maximum value for solid images, the fixable temperature $Tb_{n+4}$=Ts (reference fixable temperature). That is, under the conditions described above, the target temperature $T_n$ is 20° C. lower (=−L×4) than the reference fixable temperature Ts. The target temperature $T_n$ can be lowered only up to 20° C. from the reference fixable temperature Ts. When the image type is character image, the fixable temperature Tb in the monochrome mode is Ts−40° C. For example, when the image type of the nth page is black monochromatic character image ($D_n$=100, $I_n$=1), $Tb_n$=Ts−40° C. However, the target temperature $T_n$ can be lowered only by 20° C. from the reference fixable temperature Ts. The target temperature $T_n$ is increased further when the image information corresponding to the (n+2)th page and the image information corresponding to the (n+3)th page are not acquired.

The present embodiment sets a fixable temperature for a page for which image information is not acquired, based on the current operation mode of the image forming apparatus.

In the monochrome mode, a toner image is formed on the recording medium 11 using only the black (K) toner, and therefore the image density information $D_n$, of the nth page is 100%. As such, the fixable temperature $Tb_n$ in the monochrome mode depends on the image type information L.

When the image type is character image (image type information $I_n$=1), $Tb_n$=Ts−40° C. When the image type is solid image (image type information $I_n$=2), $Tb_n$=Ts−30° C. When the image forming apparatus is operating in the monochrome mode, the present embodiment sets the fixable temperature for a page for which image information is not acquired to the maximum temperature of the monochrome mode ($Tb_n$=Ts−30° C.).

In the color mode, the yellow (Y), magenta (M), cyan (C), and black (K) toners are used to form toner images on the recording medium 11, so that the image density information $D_n$ of the nth page is at least 100% and not more than 250%. As such, the image type information $I_n$ and the image density information $D_n$ determine the fixable temperature $Tb_n$ in the color mode. When the image forming apparatus is operating in the color mode, the present embodiment sets the fixable temperature for a page for which image information is not acquired to the maximum temperature of the color mode ($Tb_n$=Ts).

This achieves appropriate setting of the target temperature $T_n$ according to the mode in which the image forming apparatus is operating.

Figure 9A:
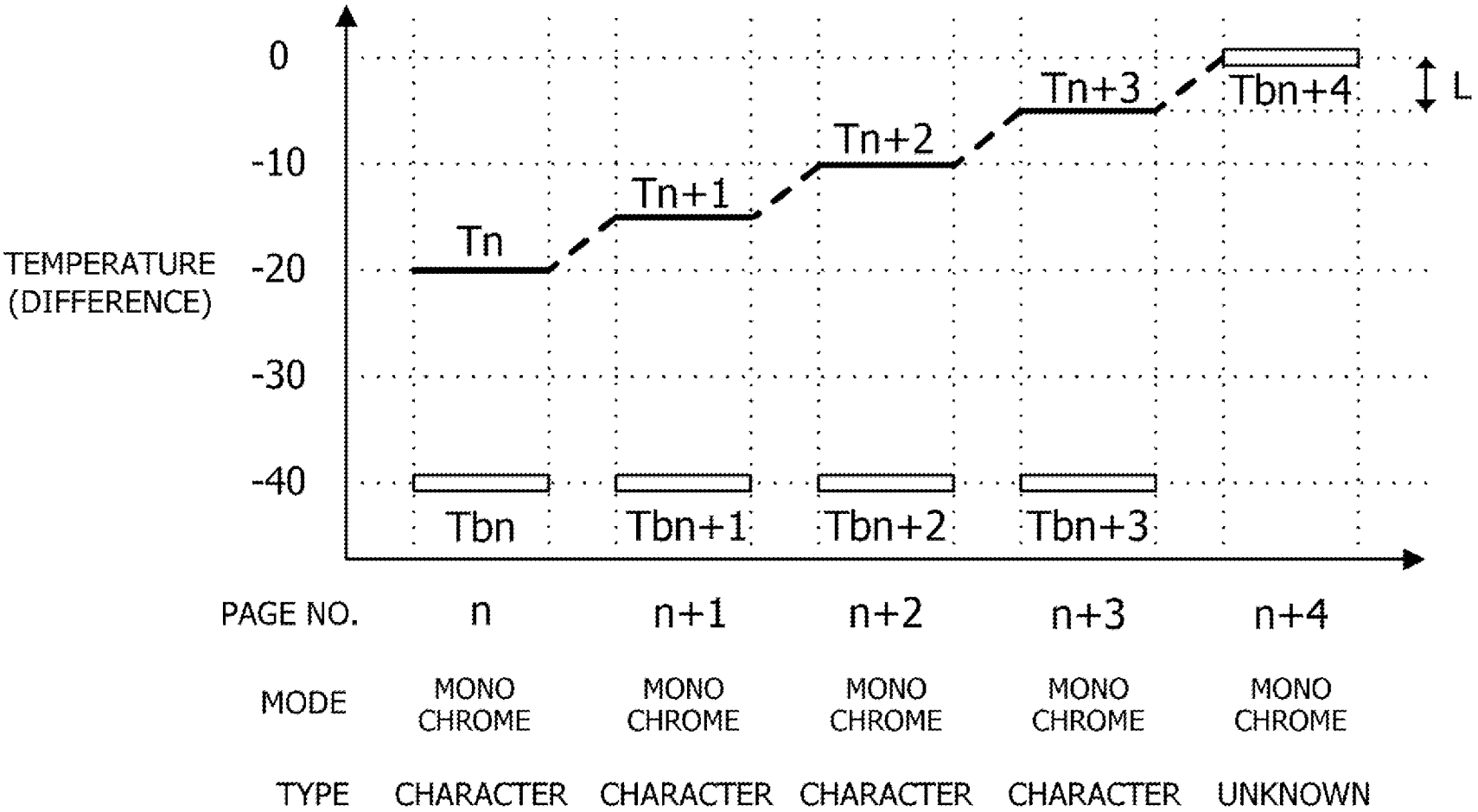
FIGS. 9A and 9B are diagrams illustrating fixable temperatures and target temperatures.
Figure 9B:
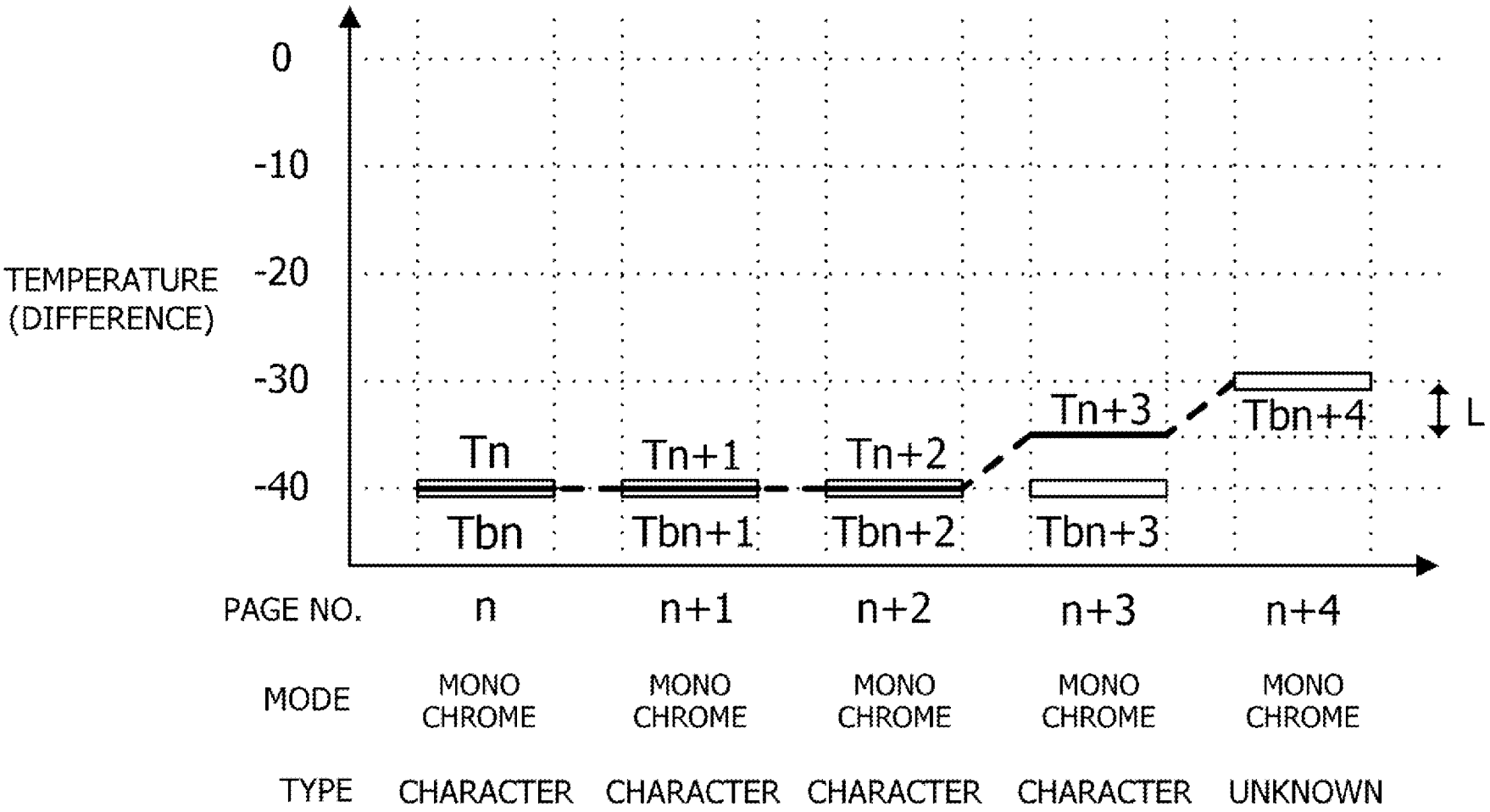
Figure 10A:
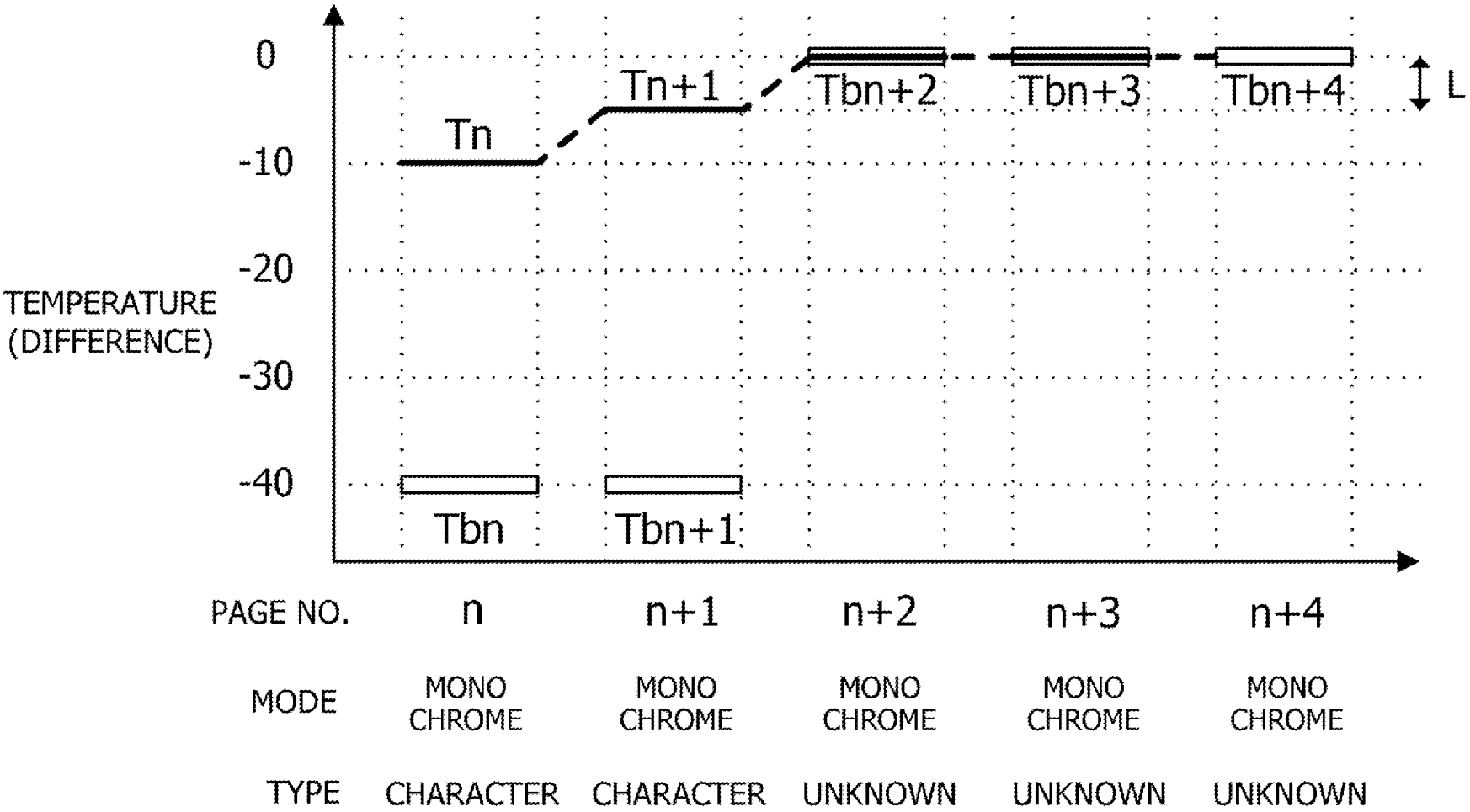
FIGS. 10A and 10B are diagrams illustrating fixable temperatures and target temperatures.
Figure 10B:
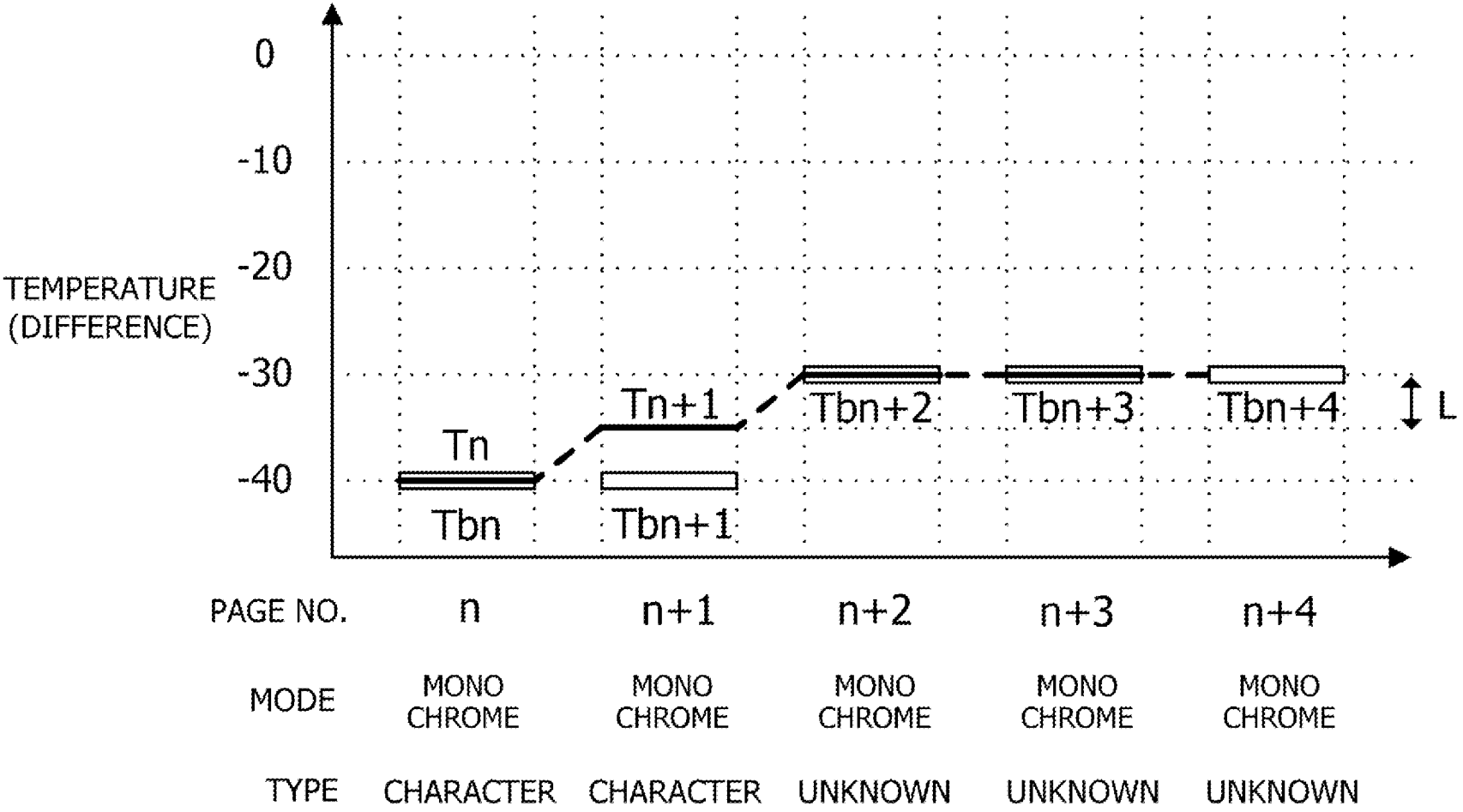

Referring to FIGS. 9A, 9B, 10A, and 10B, the fixable temperatures $Tb_n$ and the target temperatures $T_n$ are described in detail. FIGS. 9A and 10A are diagrams illustrating the fixable temperatures $Tb_n$ and the target temperatures $T_n$ of a comparison example. FIGS. 9B and 10B are diagrams illustrating the fixable temperatures $Tb_n$ and the target temperatures $T_n$ of the present embodiment. The horizontal axes in FIGS. 9A, 9B, 10A, and 10B indicate page number, and the vertical axes in FIGS. 9A, 9B, 10A, and 10B indicate temperature (difference). The temperatures (differences) in FIGS. 9A, 9B, 10A, and 10B are the differences between the reference fixable temperature Ts and the fixable temperatures $Tb_n$, and the differences between the reference fixable temperature Ts and the target temperature $T_n$.

FIGS. 9A and 9B are now described. The image forming apparatus is set to the monochrome mode and forms images in the monochrome mode. The images of the nth to (n+3)th pages are monochrome characters (image density information D=100%, image type information I=1). Since the image information corresponding to the (n+4)th page is not acquired, the image type of the (n+4)th page is unknown.

The fixable temperatures $Tb_n$ to $Tb_{n+3}$ are Ts−40° C. in the comparison example and the present embodiment. Since the image information corresponding to the (n+4)th page is not acquired, the fixable temperature $Tb_{n+4}$ in the comparison example is the reference fixable temperature Ts, and the fixable temperature $Tb_{n+4}$ in the present embodiment is Ts−30° C. The temperature rise upper limit L is 5° C. in the comparison example and the present embodiment. In the comparison example, since the fixable temperature $Tb_{n+4}$=Ts (reference fixable temperature), $T_n$=Ts−20° C. as shown in FIG. 9A. In the present embodiment, since the fixable temperature $Tb_{n+4}$=Ts−30° C. (the maximum temperature of monochrome mode), $T_n$=Ts−40° C. as shown in FIG. 9B.

FIGS. 10A and 10B are now described. The image forming apparatus is set to the monochrome mode and forms images in the monochrome mode. The images of the nth and (n+1)th pages are monochrome characters (image density information D=100%, image type information I=1). That is, the image type of the nth and (n+1)th pages is character image. Since the image information of the (n+2)th to (n+4)th pages is not acquired, the image types of the (n+2)th to (n+4)th pages are unknown.

The fixable temperatures $Tb_n$ and $Tb_{n+1}$ are Ts−40° C. in the comparison example and the present embodiment. Since the image information corresponding to the (n+2)th to (n+4)th pages is not acquired, the fixable temperatures $Tb_{n+2}$ to $Tb_{n+4}$ in the comparison example are the reference fixable temperature Ts, while the fixable temperatures $Tb_{n+2}$ to $Tb_{n+4}$ in the present embodiment are Ts−30° C. The temperature rise upper limit L is 5° C. in the comparison example and the present embodiment. In the comparison example, since the fixable temperatures $Tb_{n+2}$ to $Tb_{n+4}$=Ts (reference fixable temperature), $T_n$=Ts−10° C. as shown in FIG. 10A. In the present embodiment, since the fixable temperatures $Tb_{n+2}$ to $Tb_{n+4}$=Ts−30° C. (the maximum temperature of monochrome mode), $T_n$=Ts−40° C. as shown in FIG. 10B.

As described above, the fixable temperature for a page for which image information is not acquired is set based on the current operation mode of the image forming apparatus. When the operation mode (image forming mode) of the image forming apparatus is the monochrome mode, the fixable temperature for a page for which image information is not acquired is set to the maximum temperature of the monochrome mode. When the operation mode (image forming mode) of the image forming apparatus is the color mode, the fixable temperature for a page for which image information is not acquired is set to the maximum temperature of the color mode. This achieves appropriate setting of the target temperature $T_n$ according to the mode in which the image forming apparatus is operating. The power consumption of the image forming apparatus can be reduced accordingly.

An example is now described in which a page for which image information is not acquired is a full-color image and Tb>Ts−30° C.

When switching from the monochrome mode to the color mode, the image forming apparatus of the present embodiment brings the developing devices 26Y, 26M, and 26C into contact with the photosensitive drums 22Y, 22M, and 22C. Moving the developing devices 26 into contact during image formation, particularly while the exposure of the surface of a photosensitive drum 22 by a laser scanner 24 is in progress, may create an impact that results in unstable exposure and image distortion. For this reason, the present embodiment moves developing devices 26 into contact after completing the exposure by the laser scanner 24K. Consequently, the interval between the last page of image formation in the monochrome mode and the first page of the subsequent image formation in the color mode is longer than that in normal image formation. Even when the fixable temperature Tb of a page for which image information is not acquired is set to Ts, this longer interval for mode switching allows the temperature to rise to Ts. If the interval for mode switching is not long enough for the temperature rise, the time needed for the temperature rise may be added to the interval for switching from the monochrome mode to the color mode. Additionally, for an image forming apparatus that does not separate developing devices 26 in the monochrome mode, the time for temperature rise may be provided when the mode is changed from the monochrome mode to the color mode.

Examples of processes performed by the image analysis portion 401 and the target temperature control portion 350 in the present embodiment are described below. The target temperature control portion 350 may perform a part or all of the processes performed by the image analysis portion 401, or the image analysis portion 401 may perform a part or all of the processes performed by the target temperature control portion 350. The image analysis portion 401 acquires image information and operation information of the image forming apparatus. The image analysis portion 401 is an example of an acquiring portion. In the examples described below, the image analysis portion 401 acquires the image information corresponding to at least one first page, but fails to acquire the image information corresponding to at least one second page following the first page. In the example in FIG. 9B, the nth to (n+3)th pages are first pages, and the (n+4)th page is a second page. In the example in FIG. 10B, the nth and (n+1)th pages are first pages, and the (n+2)th to (n+4)th pages are second pages. The operation information of the image forming apparatus may be setting information of the image forming mode, for example. The operation information of the image forming apparatus may include color mode setting information or monochrome mode setting information.

Based on the image information corresponding to each first page and the operation information of the image forming apparatus, the target temperature control portion 350 sets a setting temperature for the first pages as a first temperature (fixable temperature Tb). The setting temperature for the first pages is the temperature of the fixing portion 50 or the temperature (setting temperature) of the heater 63 for fixing the first pages. Further, the setting temperature for the first pages may be considered as the temperature relating to the temperature of the fixing portion 50 or the temperature of the heater 63 for fixing the first pages. In the example in FIG. 9B, the target temperature control portion 350 sets the setting temperature for the nth to (n+3)th pages as a first temperature ($Tb_n$, $Tb_{n+1}$, $Tb_{n+2}$, and $Tb_{n+3}$) based on the image information corresponding to each of the nth to (n+3)th pages and the monochrome mode setting information. In the example shown FIG. 10B, the target temperature control portion 350 sets the setting temperature for the nth and (n+1)th pages as a first temperature ($Tb_n$ and $Tb_{n+1}$) based on the image information corresponding to each of the nth and (n+1)th pages and the monochrome mode setting information.

Based on the operation information of the image forming apparatus, the target temperature control portion 350 sets the setting temperature for the second pages as a second temperature (fixable temperature Tb). The setting temperature for the second pages is the temperature of the fixing portion 50 or the temperature of the heater 63 for fixing the second pages. The setting temperature for the second pages may be considered as the temperature relating to the temperature of the fixing portion 50 or the temperature of the heater 63 for fixing the second pages. In the example in FIG. 9B, the target temperature control portion 350 sets the setting temperature for the (n+4)th page as a second temperature ($Tb_{n+4}$) based on the monochrome mode setting information. In the example in FIG. 10B, the target temperature control portion 350 sets the setting temperature for the (n+2)th to (n+4)th pages as a second temperature ($Tb_{n+2}$, $Tb_{n+3}$, and $Tb_{n+4}$) based on the monochrome mode setting information.

The target temperature control portion 350 sets target temperatures (first target temperatures) for the first pages based on the first temperature and the second temperature. In the example in FIG. 9B, the target temperature control portion 350 sets target temperatures ($T_n$, $T_{n+1}$, $T_{n+2}$, and $T_{n+3}$) for the nth to (n+3)th pages based on the first temperature ($Tb_n$, $Tb_{n+1}$, $Tb_{n+2}$, and $Tb_{n+3}$) and the second temperature ($Tb_{n+4}$). In the example in FIG. 10B, the target temperature control portion 350 sets target temperatures ($T_n$ and $T_{n+1}$) for the nth and (n+1)th pages based on the first temperature ($Tb_n$ and $Tb_{n+1}$) and the second temperature ($Tb_{n+2}$, $Tb_{n+3}$, and $Tb_{n+4}$).

The temperature difference (difference) between the target temperature set for the last page of the first pages and the second temperature is less than or equal to a predetermined temperature (predetermined value). In the example in FIG. 9B, the temperature difference between the target temperature set for the (n+3)th page ($T_{n+3}$) and the second temperature ($Tb_{n+4}$) is less than or equal to the temperature rise upper limit L, which is a predetermined temperature (predetermined value). In the example in FIG. 10B, the temperature difference between the target temperature set for the (n+1)th page ($T_{n+1}$) and the second temperature ($Tb_{n+2}$) is less than or equal to the temperature rise upper limit L.

The number of the first pages is n (n is an integer of at least 2), and the temperature difference between the target temperature set for one of two successive pages in the n first pages and the target temperature set for the other of these successive pages is less than or equal to the predetermined temperature (predetermined value). In the example in FIG. 9B, the number of first pages (the nth to (n+3)th pages) is four. In the example in FIG. 9B, the temperature difference between the target temperature ($T_{n+2}$) for one of two successive pages in the four first pages (e.g., the (n+2)th page) and the target temperature ($T_{n+3}$) for the other (e.g., the (n+3)th page) is less than or equal to the temperature rise upper limit L. In the example in FIG. 10B, the number of first pages (the nth and (n+1)th pages) is two. In the example in FIG. 10B, the temperature difference between the target temperature ($T_n$) for one of the two successive first pages (nth page) and the target temperature ($T_{n+1}$) for the other (the (n+1)th page) is less than or equal to the temperature rise upper limit L.

When the operation information of the image forming apparatus includes the color mode setting information, the target temperature control portion 350 sets a first upper limit and a first lower limit of the first temperature, and sets the second temperature to a first value. Since the setting range (temperature range) of fixable temperatures Tb in the color mode is Ts to Ts−40° C., the target temperature control portion 350 sets a first upper limit (Ts) of the first temperature, and sets a first lower limit (Ts−40° C.) of the first temperature. When the image forming apparatus is operating in the color mode, the fixable temperature for a page for which image information is not acquired is the maximum temperature of the color mode (Ts). The target temperature control portion 350 therefore sets the second temperature to a first value (Ts).

The target temperature control portion 350 thus sets the first upper limit (Ts) of the first temperature and sets the second temperature to the first value (Ts). The first upper limit (Ts) of the first temperature is therefore equal to the first value (Ts).

When the operation information of the image forming apparatus includes the monochrome mode setting information, the target temperature control portion 350 sets a second upper limit and a second lower limit of the first temperature, and sets the second temperature to a second value. Since the setting range (temperature range) of fixable temperatures Tb in the monochrome mode is Ts−30° C. to Ts−40° C., the target temperature control portion 350 sets a second upper limit (Ts−30° C.) of the first temperature, and sets a second lower limit (Ts−40° C.) of the first temperature. When the image forming apparatus is operating in the monochrome mode, the fixable temperature for a page for which image information is not acquired is the maximum temperature of the monochrome mode (Ts−30° C.). The target temperature control portion 350 therefore sets the second temperature to a second value (Ts−30° C.).

The target temperature control portion 350 thus sets the second upper limit (Ts−30° C.) of the first temperature and sets the second temperature to the second value (Ts−30° C.). The second upper limit (Ts−30° C.) of the first temperature is therefore equal to the second value (Ts−30° C.). The second upper limit (Ts−30° C.) of the first temperature is less than the first upper limit (Ts) of the first temperature, and the second value (Ts−30° C.) is less than the first value (Ts). Further, the first lower limit (Ts−40° C.) of the first temperature is equal to the second lower limit (Ts−40° C.) of the first temperature.

An example is described below in which the image analysis portion 401 acquires the image information corresponding to at least one first page, and acquires the image information corresponding to at least one second page following the first page.

Based on the image information corresponding to each first page and the operation information of the image forming apparatus, the target temperature control portion 350 sets a setting temperature for the first pages as a third temperature (fixable temperature Tb). The setting temperature for the first pages is the temperature of the fixing portion 50 or the temperature (setting temperature) of the heater 63 for fixing the first pages. Further, the setting temperature for the first pages may be considered as the temperature relating to the temperature of the fixing portion 50 or the temperature of the heater 63 for fixing the first pages.

When the image analysis portion 401 acquires the image information corresponding to the second page, the target temperature control portion 350 performs the same process as in the case where the image analysis portion 401 acquires the image information corresponding to the first page. That is, based on the image information corresponding to the second pages and the operation information of the image forming apparatus, the target temperature control portion 350 sets a setting temperature for the second pages as a fourth temperature (fixable temperature Tb). The setting temperature for the second pages is the temperature of the fixing portion 50 or the temperature (setting temperature) of the heater 63 for fixing the second pages. Further, the setting temperature for the second pages may be considered as the temperature relating to the temperature of the fixing portion 50 or the temperature of the heater 63 for fixing the second pages. The image type of the image information corresponding to the second pages can be determined when the image analysis portion 401 acquires the image information corresponding to the second pages. As such, when the image analysis portion 401 acquires the image information corresponding to the second pages, the target temperature control portion 350 sets the setting temperature for the second pages based on the image information corresponding to the second pages and the operation information of the image forming apparatus, in the same manner as the first pages.

Based on the third and fourth temperatures, the target temperature control portion 350 sets target temperatures (second target temperatures) for the first pages.

Second Embodiment

Referring to FIGS. 11A to 11C and 12A to 12C, a second embodiment is now described.

The second embodiment differs from the first embodiment in that, when the image forming apparatus determines to terminate an image forming operation, a setting range (temperature range) is set for the fixable temperature for a page for which image information is not acquired. Most of the configurations and operations of the image forming apparatus are the same as those of the first embodiment described above. Only the differences from the first embodiment are described below.

When the image information corresponding to a subsequent page is not received from the host computer 300, the image forming apparatus terminates the image forming operation. When the user instructs the execution of printing via the host computer 300, the host computer 300 sequentially transmits image information to the controller portion 301. After completing the transmission of the image information for all pages to be printed, the host computer 300 does not send image information to the controller portion 301. The controller portion 301 therefore does not receive image information. However, it is not possible for the controller portion 301 to determine whether the absence of incoming image information is caused by the completion of transmission of all image information and thus the end of the print job, or by a delay in the extraction or transmission of image information. The time required to extract and transmit image information depends significantly on the size of the image and the communication state. However, the image forming apparatus needs to assume, at some point in time, that the transmission of the image information is completed and terminate the image forming operation. The image forming apparatus of the present embodiment performs the termination sequence of image forming operation when the exposure at the black (K) station for the last page is completed without the controller portion 301 receiving image information corresponding to a subsequent page from the host computer 300. However, the conditions for determining the termination of an image forming operation vary among image forming apparatuses. The timing for performing the termination sequence of image forming operation is not limited to this example.

In the color mode, if the fixable temperature for a page that is subsequent to the termination of the image forming operation and for which image information is not acquired is set to Ts (reference fixable temperature), the target temperatures $T_n$ for pages prior to the termination of the image forming operation would be high. In the monochrome mode, if the fixable temperature for a page that is subsequent to the termination of the image forming operation and for which image information is not acquired is set to Ts−30° C., the target temperature $T_n$ for pages prior to the termination of the image forming operation would be high. For this reason, when the image forming apparatus determines to terminate an image forming operation, the present embodiment lowers the fixable temperatures for pages subsequent to the termination of image forming operation. That is, a setting range (temperature range) is set for the fixable temperature for a page for which image information is not acquired. In the color mode, the upper limit of the fixable temperature for a page that is prior to the termination of the image forming operation and for which image information is not acquired is Ts. In the color mode, the lower limit of the fixable temperature for a page that is subsequent to the termination of the image forming operation and for which image information is not acquired is less than Ts. In the monochrome mode, the upper limit of the fixable temperature for a page that is prior to the termination of the image forming operation and for which image information is not acquired is Ts−30° C. Further, in the monochrome mode, the lower limit of the fixable temperature for a page that is subsequent to the termination of the image forming operation and for which image information is not acquired is less than Ts−30° C.

Figure 11A:
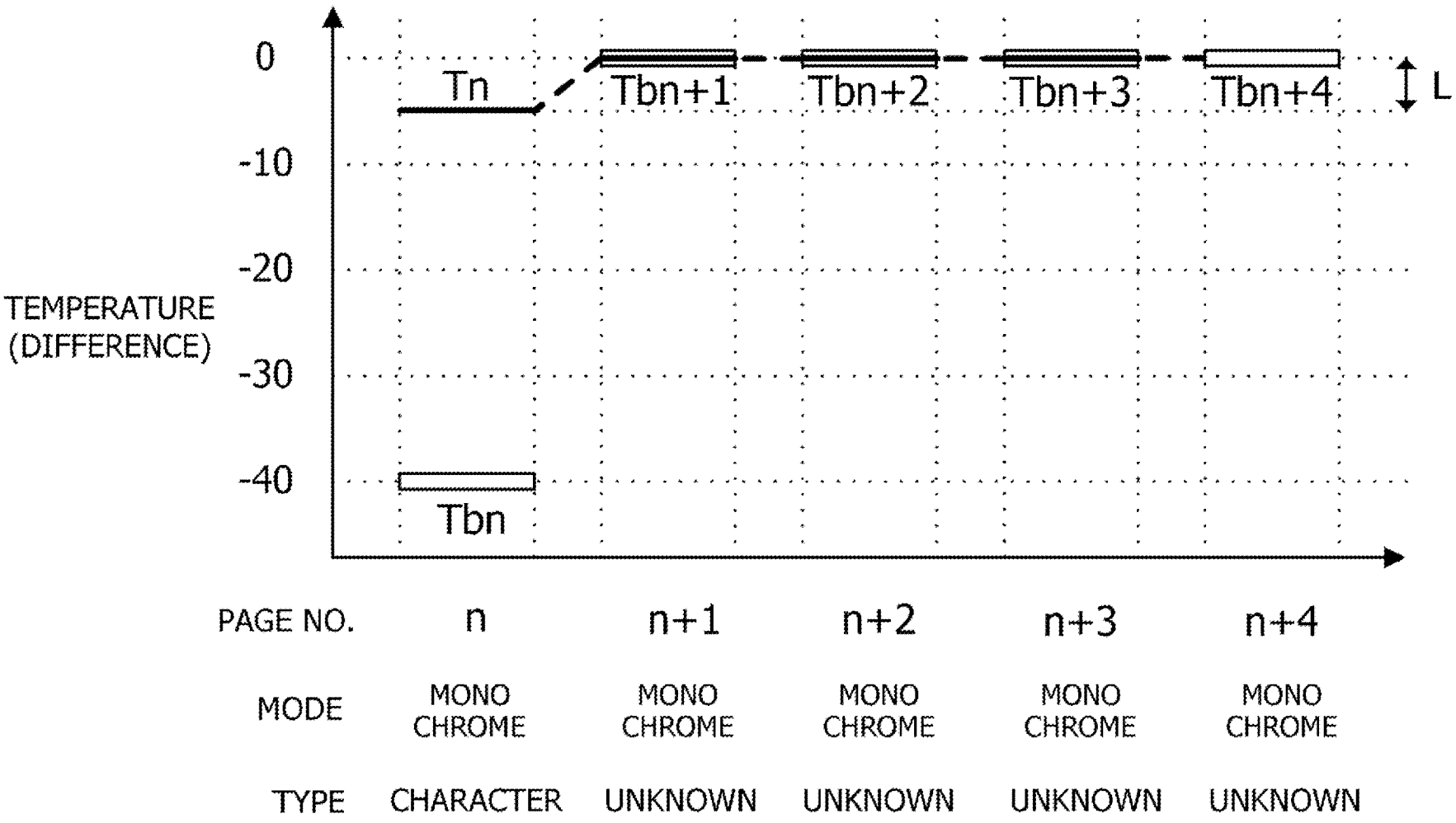
FIGS. 11A to 11C are diagrams illustrating fixable temperatures and target temperatures.
Figure 11B:
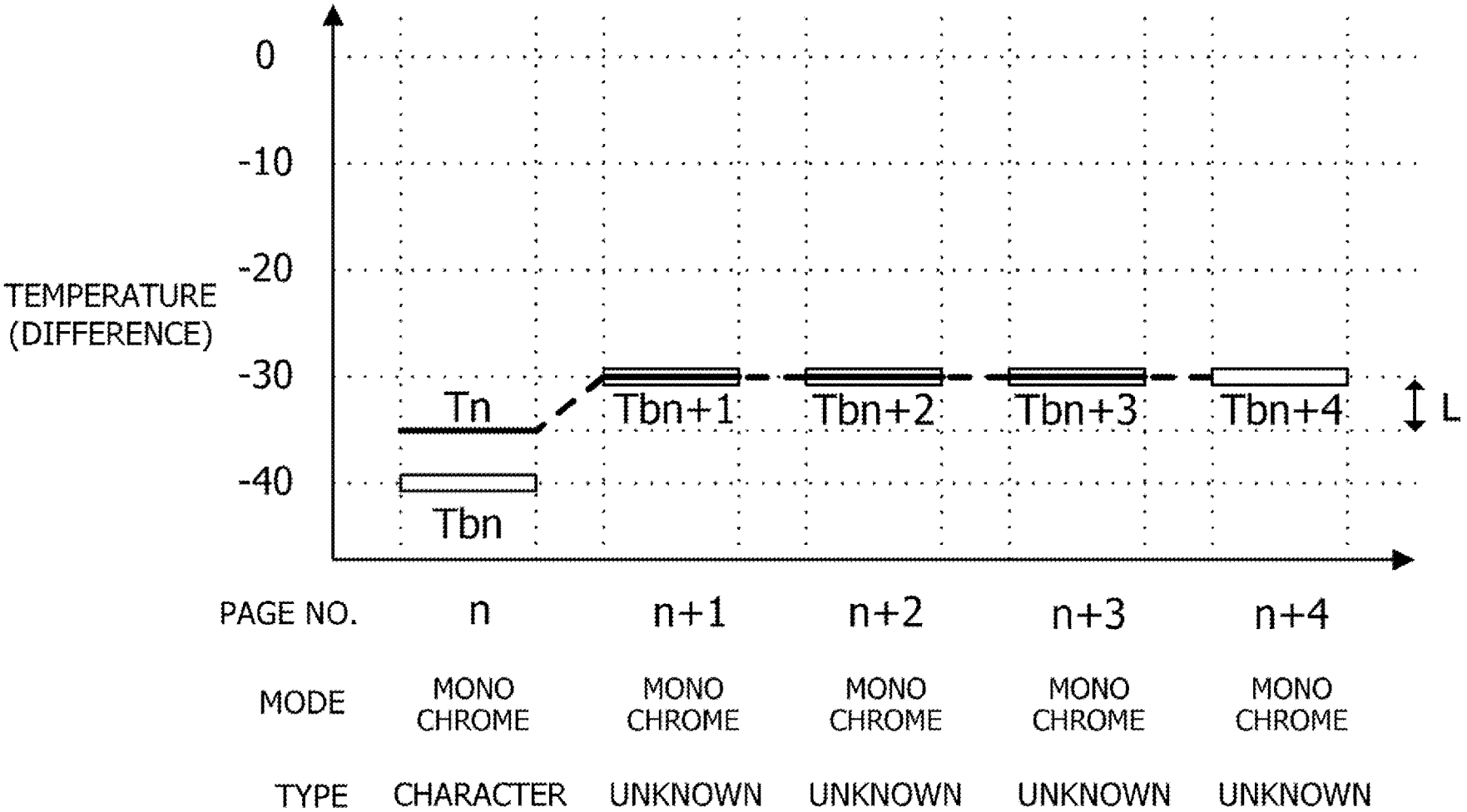
Figure 11C:
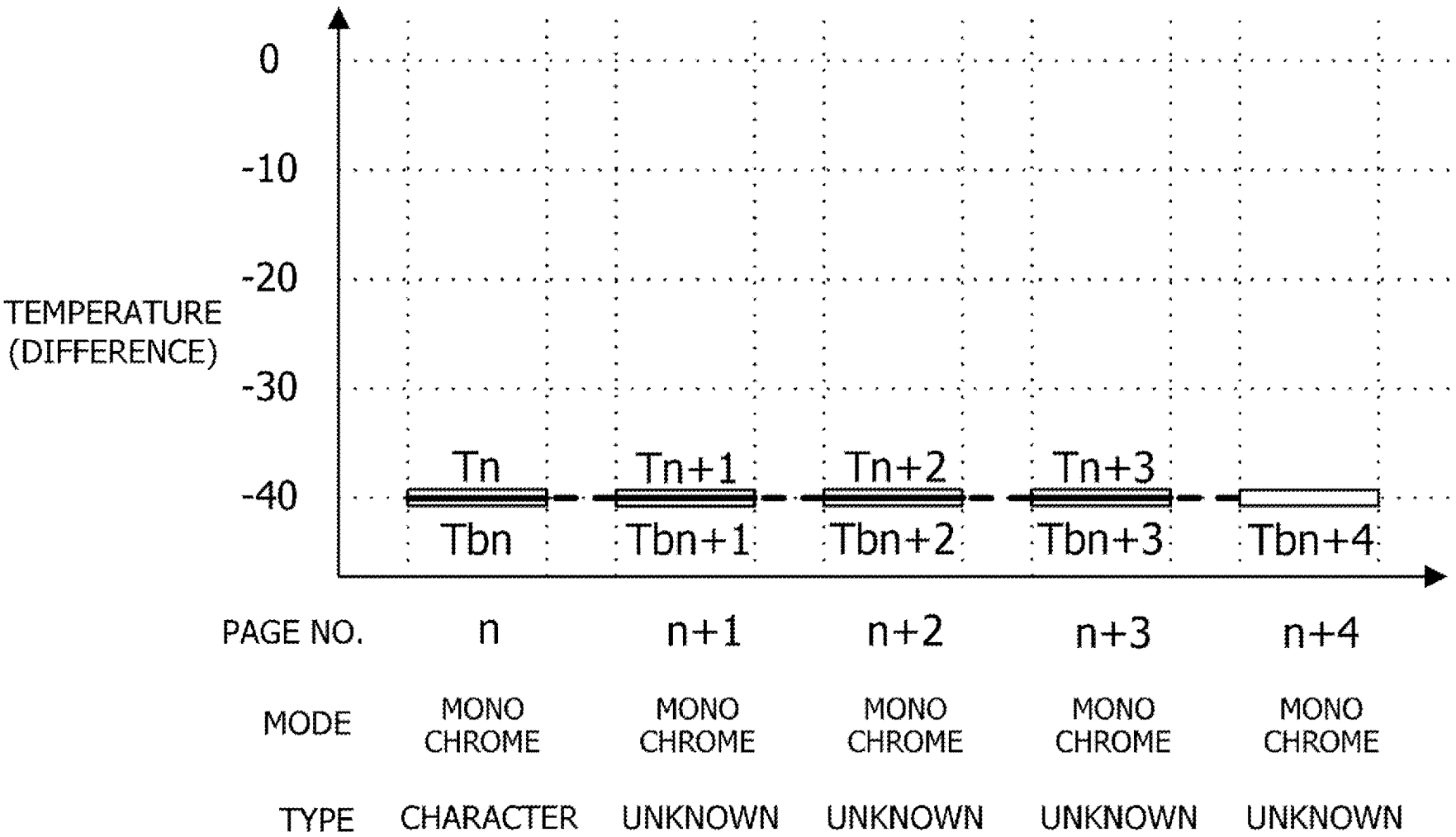
Figure 12A:
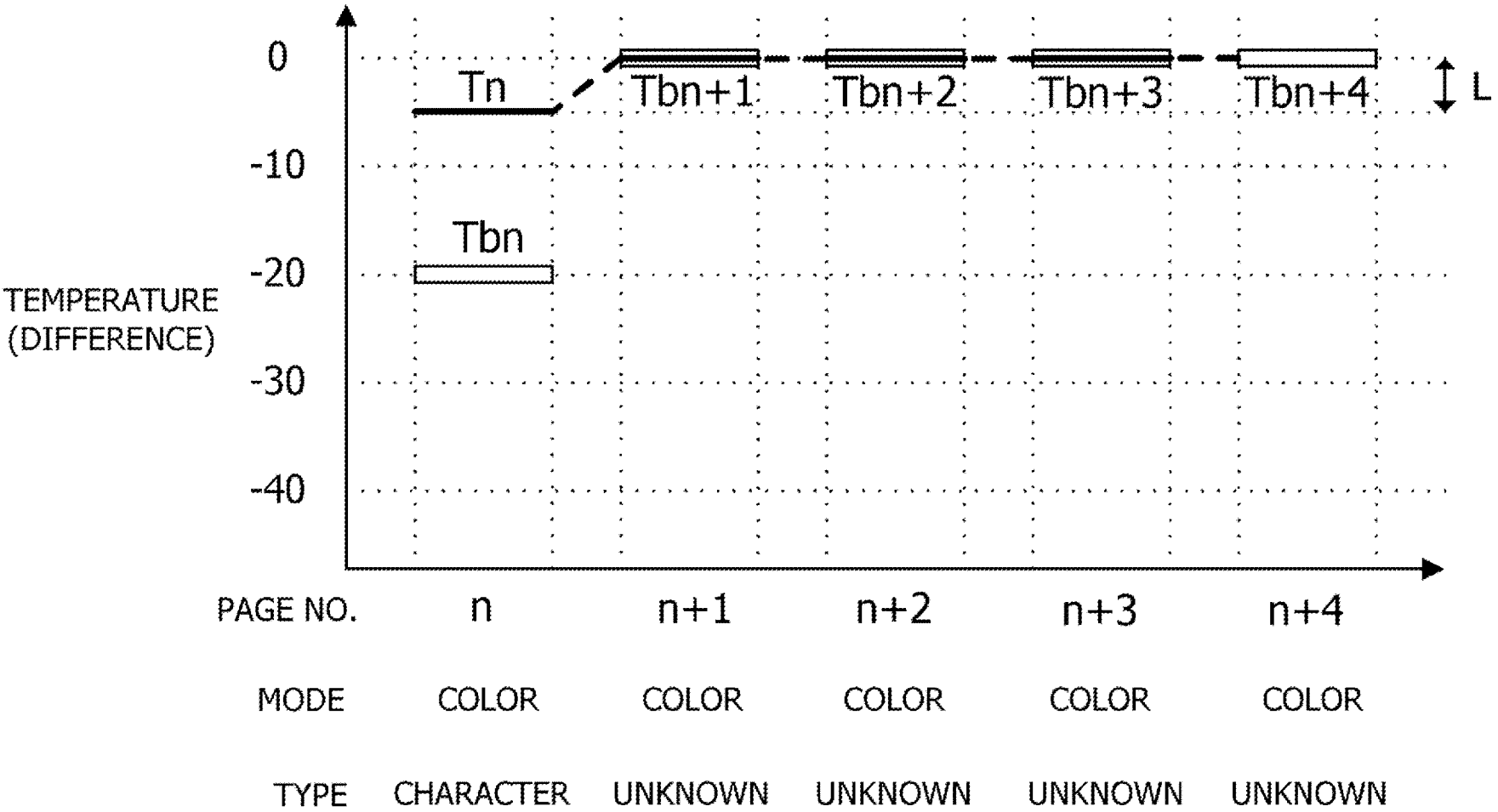
FIGS. 12A to 12C are diagrams illustrating fixable temperatures and target temperatures.
Figure 12B:
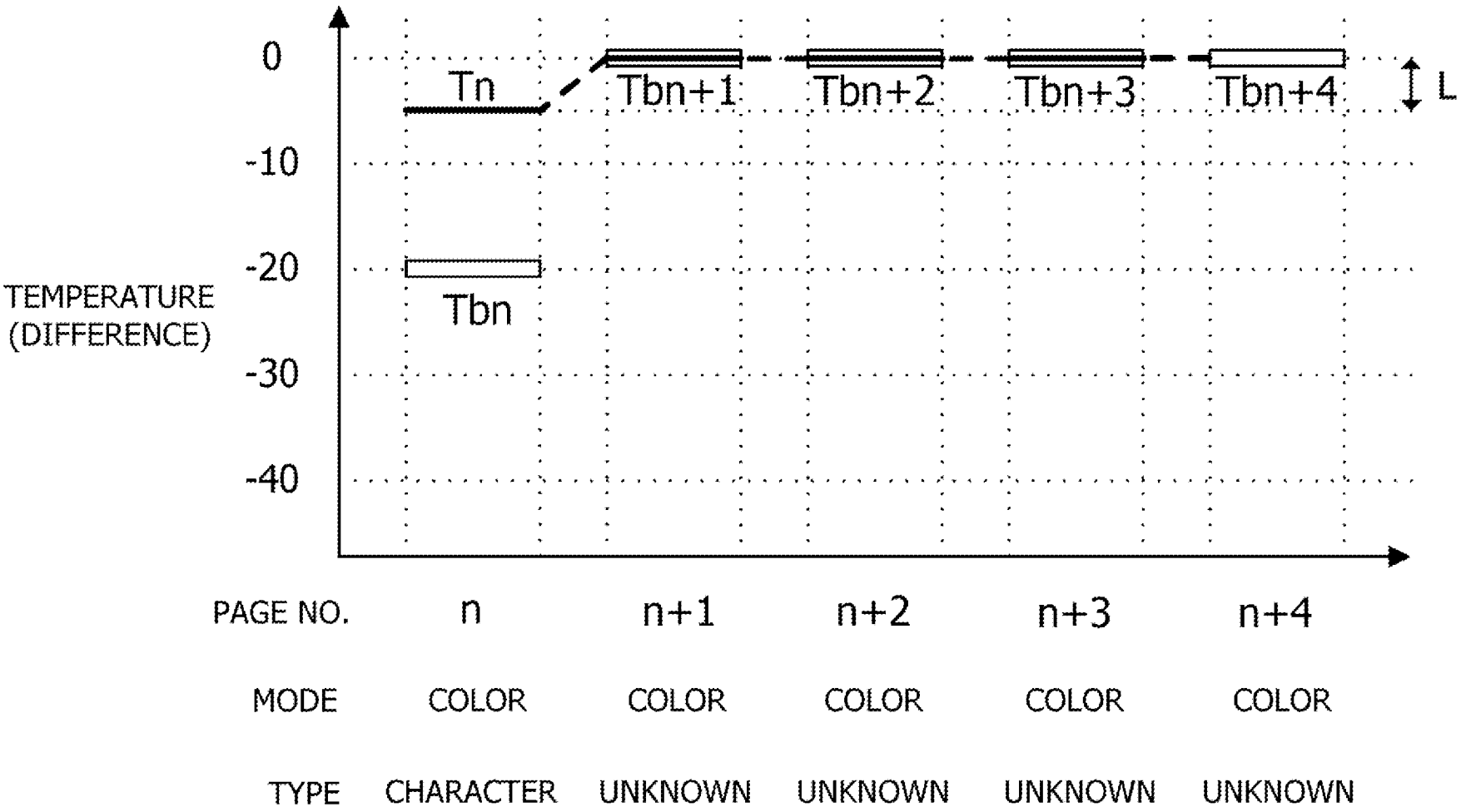
Figure 12C:
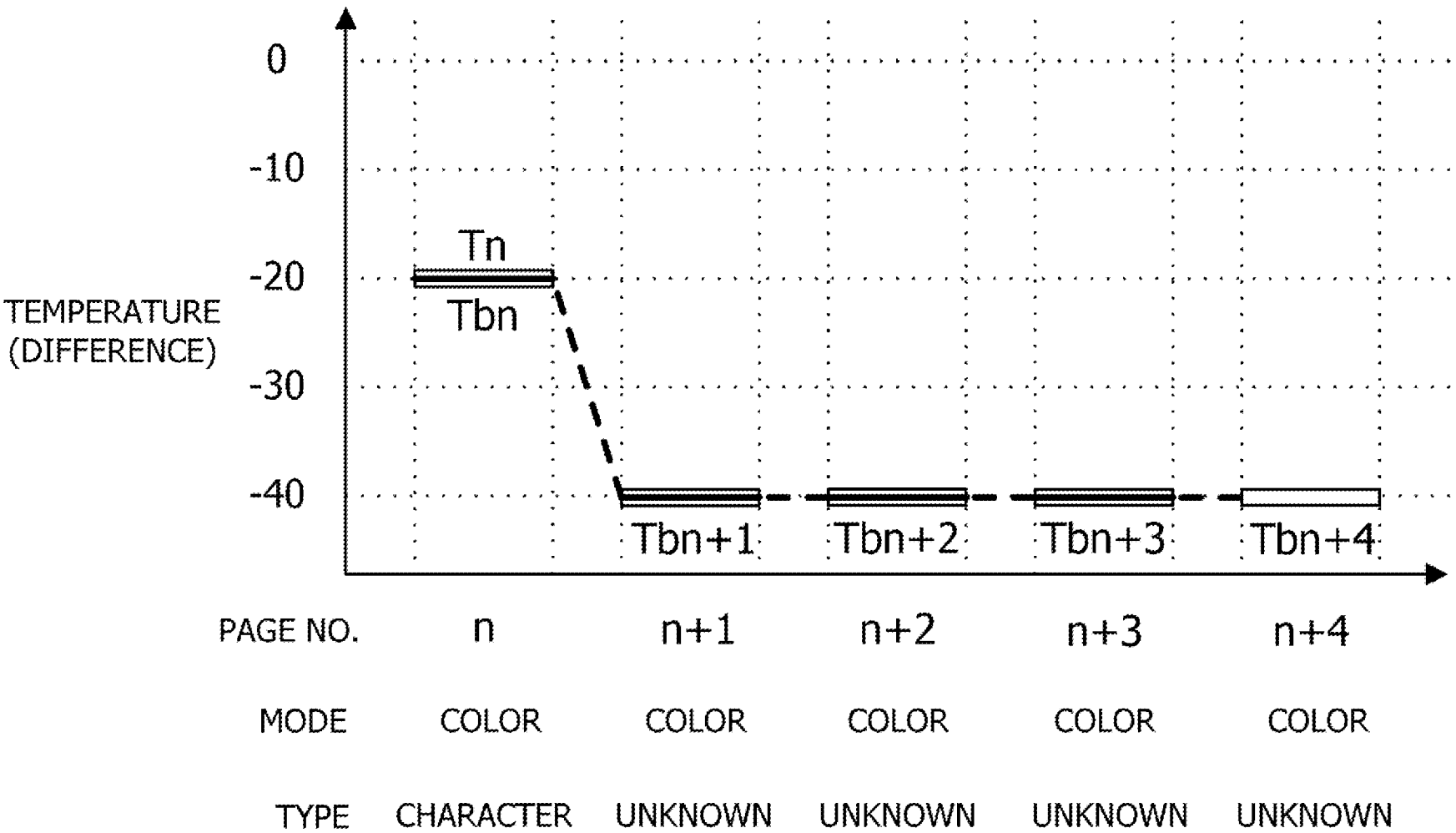

Referring to FIGS. 11A to 11C and 12A to 12C, fixable temperatures $Tb_n$ and target temperatures $T_n$ are described in detail. FIGS. 11A and 12A are diagrams illustrating fixable temperatures $Tb_n$ and target temperatures $T_n$ of the comparison example. FIGS. 11B and 12B are diagrams illustrating fixable temperatures $Tb_n$ and target temperatures $T_n$ of the first embodiment. FIGS. 11C and 12C are diagrams illustrating fixable temperatures $Tb_n$ and target temperatures $T_n$ of the present embodiment. The horizontal axes in FIGS. 11A to 11C and 12A to 12C indicate page number, and the vertical axes in FIGS. 11A to 11C and 12A to 12C indicate temperature (difference). The temperatures (differences) in FIGS. 11A to 11C and 12A to 12C are the differences between the reference fixable temperature Ts and the fixable temperatures $Tb_n$, and the differences between the reference fixable temperature Ts and the target temperatures $T_n$.

FIGS. 11A to 11C are now described. The image forming apparatus is set to the monochrome mode and forms images in the monochrome mode. The image of the nth page, which is the last page before the termination of the image forming operation, is monochrome characters (image density information D=100%, image type information I=1). Since the image information corresponding to the (n+1)th to (n+4)th pages is not acquired, the image types of these pages are unknown.

The fixable temperature $Tb_n$ is Ts−40° C. in the comparison example, the first embodiment, and the present embodiment. The image information corresponding to pages following the nth page is not received at the completion of the exposure for the nth page at the black (K) station. As such, the termination sequence of the image forming operation is determined to be performed after an image is formed on the nth page. That is, upon completing the exposure at the black (K) station for the nth page, the image forming apparatus terminates the image forming operation. The printer control device 304 sends, as the operation information of the image forming apparatus, information indicating the completion of exposure for the nth page at the black (K) station to the image analysis portion 401 and the target temperature control portion 350.

The temperature rise upper limit L is 5° C. in the comparison example, the first embodiment, and the present embodiment. Since the image information corresponding to the (n+1)th to (n+4)th pages is not acquired, the fixable temperatures $Tb_{n+1}$ to $Tb_{n+4}$ in the comparison example are the reference fixable temperature Ts, and the fixable temperatures $Tb_{n+1}$ to $Tb_{n+4}$ in the first embodiment are Ts−30° C. In the comparison example, since the fixable temperatures $Tb_{n+1}$ to $Tb_{n+4}$=Ts (reference fixable temperature), $T_n$=Ts−5° C. as shown in FIG. 11A. In the first embodiment, since the fixable temperatures $Tb_{n+1}$ to $Tb_{n+4}$ are Ts−30° C. (the maximum temperature of monochrome mode), $T_n$ is Ts−35° C. as shown in FIG. 11B. In the present embodiment, the image information of the (n+1)th to (n+4)th pages is not acquired, but the image forming operation terminates after the image of the nth page is formed. In the present embodiment, since the fixable temperatures $Tb_{n+1}$ to $Tb_{n+4}$ are Ts−40° C. (the minimum temperature of monochrome mode), $T_n$ is Ts−40° C. as shown in FIG. 11C.

FIGS. 12A to 12C are now described. The image forming apparatus is set to the color mode and forms images in the color mode. The image of the nth page, which is the last page before the termination of the image forming operation, is color characters (image density information D=200%, image type information I=1). The image information corresponding to the (n+1)th to (n+4)th pages is not acquired and thus the image types of these pages are unknown.

The fixable temperature $Tb_n$ is Ts−20° C. in the comparison example, the first embodiment, and the present embodiment. The image information corresponding to pages following the nth page is not received at the completion of the exposure for the nth page at the black (K) station. As such, the termination sequence of the image forming operation is determined to be performed after an image is formed on the nth page. That is, upon completing the exposure at the black (K) station for the nth page, the image forming apparatus terminates the image forming operation.

The temperature rise upper limit L is 5° C. in the comparison example, the first embodiment, and the present embodiment. Since the image information corresponding to the (n+1)th to (n+4)th pages is not acquired, the fixable temperatures $Tb_{n+1}$+1 to $Tb_{n+4}$ in the comparison example are the reference fixable temperature Ts. In the comparison example, since the fixable temperatures $Tb_{n+1}$ to $Tb_{n+4}$=Ts (reference fixable temperature), $T_n$=Ts−5° C. as shown in FIG. 12A. Further, since the image information of the (n+1)th to (n+4)th pages is not acquired, the fixable temperatures $Tb_{n+1}$ to $Tb_{n+4}$ in the first embodiment are Ts (the maximum temperature of color mode). In the first embodiment, since the fixable temperatures $Tb_{n+1}$ to $Tb_{n+4}$=Ts (the maximum temperature of color mode), $T_n$=Ts−5° C. as shown in FIG. 11B. In the present embodiment, the image information of the (n+1)th to (n+4)th pages is not acquired, but the image forming operation terminates after the image of the nth page is formed. In the present embodiment, the fixable temperatures $Tb_{n+1}$ to $Tb_{n+4}$ are Ts−40° C. (the minimum temperature in color mode), and $T_n$=Ts−20° C. as shown in FIG. 12C.

In the image forming apparatus of the present embodiment, the length of the image conveying path from the exposure position on the photosensitive drum 22 at the black (K) station to the nip position of the fixing portion 50 is longer than the length (longitudinal length) of size A4, or 297 mm, of the recording medium 11 of the image forming apparatus. Accordingly, upon completion of the exposure at the black (K) station, the target temperature $T_n$ for the nth page can be set by taking account of the information that the image forming operation of the nth page terminates.

There are situations in which the acquirement of image information restarts after some delay in extracting or transmitting image information, or another print job starts after the termination of the image forming operation is determined. In such a case, after completing the image formation termination sequence, such as separating the developing devices 26, the image forming apparatus performs the image formation starting sequence, such as bringing the developing devices 26 into contact, to start an image forming operation. The image formation starting sequence generally provides sufficient time for the temperature of the heater 63 or the fixing portion 50 to rise to the target temperature when an image forming operation is restarted. To set the target temperatures $T_n$ for pages after a restart of image forming operation, calculation is performed by assigning 1 to n of the nth page after the restart.

The setting range (temperature range) of the fixable temperatures for pages for which image information is not acquired may have an intermediate value that is greater than the lower limit and less than the upper limit. Depending on the configuration of the image forming apparatus and the lengths of the image formation termination sequence and the image formation starting sequence, the use of an intermediate value in setting fixable temperatures for pages subsequent to the termination of image formation may expedite the restart of an image forming operation.

As described above, the present embodiment sets the lower limit of the setting range (temperature range) of the fixable temperatures for pages subsequent to the termination of image forming operation when the image forming apparatus determines to terminate the image forming operation. This achieves appropriate setting of the target temperature $T_n$ according to the mode in which the image forming apparatus is operating. Additionally, the target temperature $T_n$ is further lowered, reducing the power consumption of the image forming apparatus.

The present embodiment sets the lower limit of the setting range of the fixable temperatures for pages subsequent to the termination of image forming operation according to the image forming mode. The lower limit of the setting range of the fixable temperatures for pages subsequent to the termination of image forming operation may be set irrespective of the image forming mode.

The foregoing description of the present embodiment concerns an example in which the image forming apparatus determines to terminate the image forming operation. However, the process described above is also applicable to the case in which a suspension of an image forming operation is determined. The situation in which an image forming operation is suspended refers to a situation in which the interval between image forming operations is extended while printing multiple pages, due to operations different from the normal image forming operation. The operations different from the normal image forming operation include adjustment of the developing devices 26, density calibration, and cooling operation performed when continuous printing has increased the temperature of the image forming apparatus. In this case, according to the time for suspending the image forming operation, an intermediate value that is greater than the lower limit of the setting range of the fixable temperatures may be set for pages subsequent to the suspension of image forming operation. The target fixing temperatures for pages prior to the suspension of image forming operation may be calculated based on the intermediate value. To set the target temperatures $T_n$ for pages subsequent to the suspension of image forming operation, the calculation is performed by assigning 1 to n of the nth page after the suspension.

Examples of processes performed by the image analysis portion 401 and the target temperature control portion 350 in the present embodiment are described below. The target temperature control portion 350 may perform a part or all of the processes performed by the image analysis portion 401, or the image analysis portion 401 may perform a part or all of the processes performed by the target temperature control portion 350.

The image analysis portion 401 acquires image information and the operation information of the image forming apparatus. In the examples described below, the image analysis portion 401 acquires the image information corresponding to at least one first page, but fails to acquire the image information corresponding to at least one second page following the first page. In the examples in FIGS. 11C and 12C, the nth page is a first page, and the (n+1)th to (n+4)th pages are second pages. The operation information of the image forming apparatus may include color mode setting information or monochrome mode setting information, and information on a termination of the operation of the image forming portion. For example, the information on a termination of the operation of the image forming portion may be information indicating that the exposure at the black (K) station is completed.

When the operation information of the image forming apparatus includes the color mode setting information and the information on a termination of the operation of the image forming portion, the target temperature control portion 350 sets a first upper limit and a first lower limit of the first temperature, and set the second temperature to a first value.

Since the setting range (temperature range) of fixable temperatures Tb in the color mode is Ts to Ts−40° C., the target temperature control portion 350 sets a first upper limit (Ts) of the first temperature, and sets a first lower limit (Ts−40° C.) of the first temperature. When the image forming apparatus is operating in the color mode and the image forming apparatus terminates the image forming operation, the fixable temperature for a page for which image information is not acquired is the minimum temperature of the color mode (Ts−40° C.). The target temperature control portion 350 therefore sets the second temperature to a first value (Ts−40° C.).

The target temperature control portion 350 thus sets the first lower limit (Ts−40° C.) of the first temperature and sets the second temperature to the first value (Ts−40° C.). The first lower limit (Ts−40° C.) of the first temperature is therefore equal to the first value (Ts−40° C.).

When the operation information of the image forming apparatus includes the monochrome mode setting information and the information on a termination of the operation of the image forming portion, the target temperature control portion 350 sets a second upper limit and a second lower limit of the first temperature, and set the second temperature to a second value.

Since the setting range (temperature range) of fixable temperatures Tb in the monochrome mode is Ts−30° C. to Ts−40° C., the target temperature control portion 350 sets a second upper limit (Ts−30° C.) of the first temperature, and sets a second lower limit (Ts−40° C.) of the first temperature. When the image forming apparatus is operating in the monochrome mode and the image forming apparatus terminates the image forming operation, the fixable temperature for a page for which image information is not acquired is the minimum temperature in the monochrome mode (Ts−40° C.). The target temperature control portion 350 therefore sets the second temperature to a second value (Ts−40° C.).

The target temperature control portion 350 thus sets the second lower limit (Ts−40° C.) of the first temperature and sets the second temperature to the second value (Ts−40° C.). The second lower limit (Ts−40° C.) of the first temperature is therefore equal to the second value (Ts−40° C.). The second upper limit (Ts−30° C.) of the first temperature is less than the first upper limit (Ts) of the first temperature, and the first value (Ts−40° C.) is equal to the second value (Ts−40° C.).

Third Embodiment

Figure 13A:
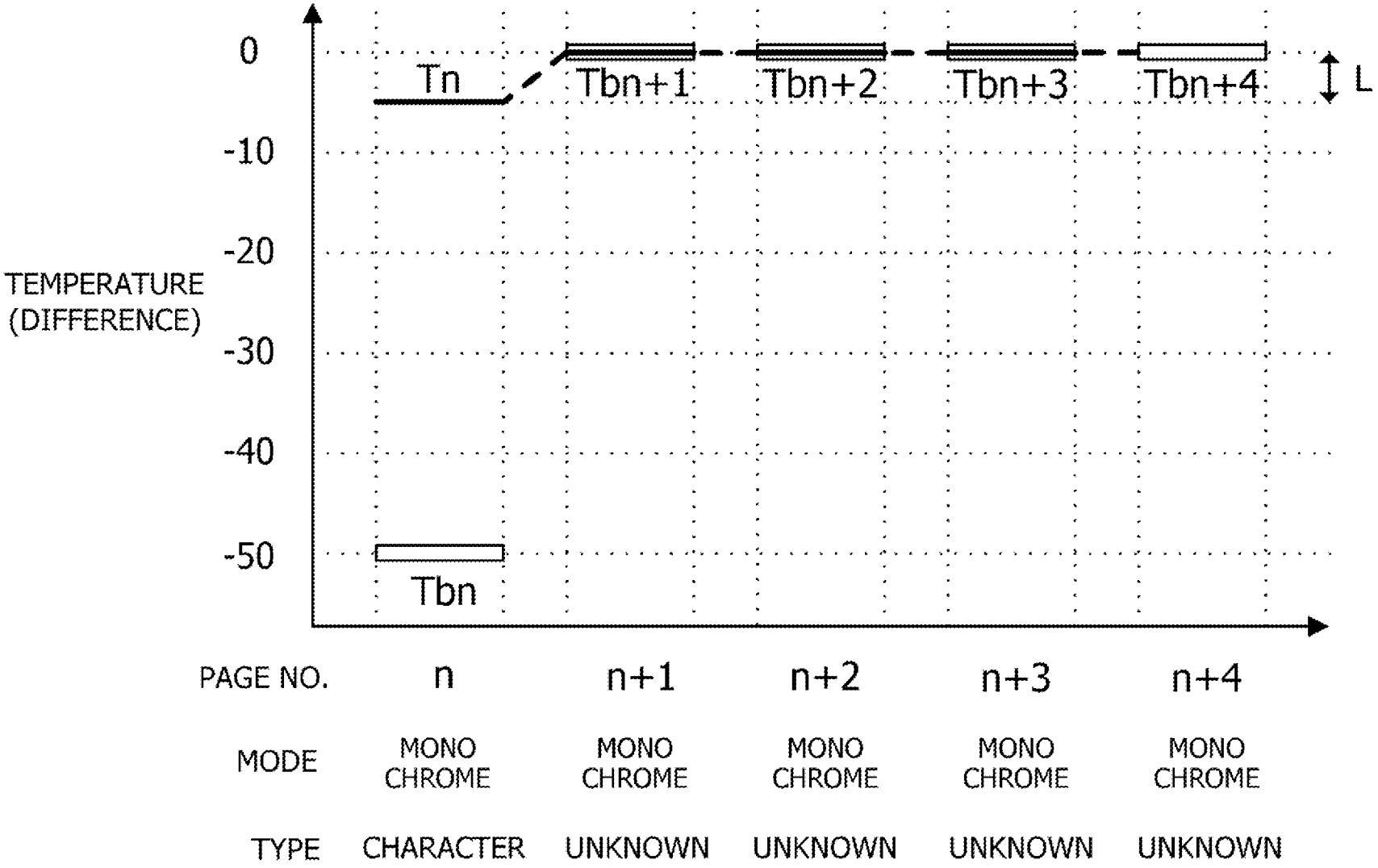
FIGS. 13A and 13B are diagrams illustrating fixable temperatures and target temperatures.
Figure 13B:
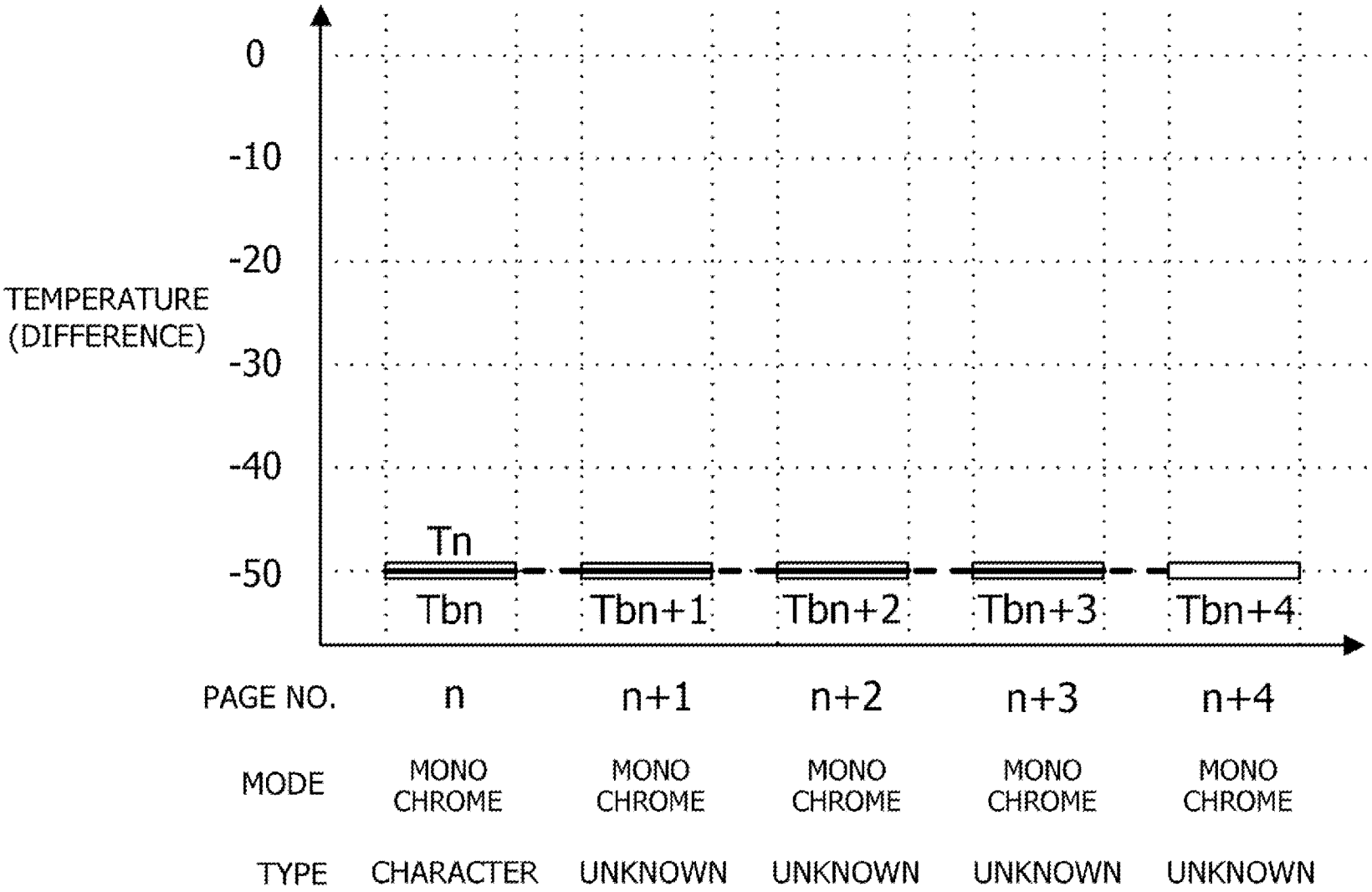

Referring to FIGS. 13A and 13B, a third embodiment is now described.

The third embodiment differs from the first and second embodiments in that black toner has a lower melting temperature than color toner. Most of the configurations and operations of the image forming apparatus are the same as those of the first and second embodiments described above. Only the differences from the first and second embodiments are described below.

The fixable temperature of the black (K) toner of the present embodiment is 10° C. lower than that of the color toner (Y, M, and C) of the same amount of about 0.4 mg/cm$^2$.

In the present embodiment, the fixable temperature $Tb_n$ for the nth page (fixable temperature $Tb_n$) is given by following Expressions 1 to 4.

When the image of the nth page is a black-only character image (image type information $I_n$=1), the fixable temperature $Tb_n$ is given by Expression 1 below.

$$Tb_n=Ts-70+(0.2\times D_n)(D_n=100) \quad \text{(Expression 1)}$$

When the image of the nth page is a black-only solid image (image type information $I_n$=2), the fixable temperature $Tb_n$ is given by Expression 2 below.

$$Tb_n=Ts-60+(0.2\times D_n)(D_n=100) \quad \text{(Expression 2)}$$

When the image of the nth page is a color character image (image type information $I_n$=1), the fixable temperature $Tb_n$ is given by Expression 3 below.

$$Tb_n=Ts-60+(0.2\times D_n)(100\leq D_n\leq 250) \quad \text{(Expression 3)}$$

When the image of the nth page is a color solid image (image type information $I_n$=2), the fixable temperature $Tb_n$ is given by Expression 4 below.

$$Tb_n=Ts-50+(0.2\times D_n)(100\leq D_n\leq 250) \quad \text{(Expression 4)}$$

The present embodiment sets a fixable temperature for a page for which image information is not acquired based on the current operation mode of the image forming apparatus.

The fixable temperature $Tb_n$ in the monochrome mode depends on the image type information $I_n$. When the image type is character image (image type information $I_n$=1), $Tb_n$=Ts−50° C. When the image type is solid image (image type information $I_n$=2), $Tb_n$=Ts−40° C. When the image forming apparatus is operating in the monochrome mode, the present embodiment sets the fixable temperature for a page for which image information is not acquired to the maximum temperature of the monochrome mode ($Tb_n$=Ts−40° C.).

The fixable temperature $Tb_n$ in the color mode depends on the image type information $I_n$ and the image density information $D_m$ When the image type is character image (image type information $I_n$=1), $Tb_n$=Ts−10° C. to Ts−40° C. When the image type is solid image (image type information $I_n$=2), $Tb_n$=Ts to Ts−30° C. When the image forming apparatus is operating in the color mode, the present embodiment sets the fixable temperature for a page for which image information is not acquired to the maximum temperature of the color mode ($Tb_n$=Ts).

Referring to FIGS. 13A and 13B, the fixable temperatures $Tb_n$ and the target temperatures $T_n$ are described in detail. FIG. 13A is a diagram illustrating the fixable temperature $Tb_n$ and the target temperature $T_n$ of the comparison example. FIG. 13B is a diagram illustrating fixable temperature $Tb_n$ and target temperature $T_n$ of the present embodiment. The horizontal axes in FIGS. 13A and 13B indicate page number, and the vertical axes in FIGS. 13A and 13B indicate temperature (difference). The temperatures (differences) in FIGS. 13A and 13B are the differences between the reference fixable temperature Ts and the fixable temperatures $Tb_n$, and the differences between the reference fixable temperature Ts and the target temperatures $T_n$.

The image forming apparatus is set to the monochrome mode and forms images in the monochrome mode. The image of the nth page, which is the last page before the termination of the image forming operation, is monochrome characters (image density information D=100%, image type information I=1). The image information corresponding to the (n+1)th to (n+4)th pages is not acquired and thus the image types of these pages are unknown.

The fixable temperature $Tb_n$ is Ts−50° C. in the comparison example and the present embodiment. The image information corresponding to pages following the nth page is not received at the completion of the exposure for the nth page at the black (K) station. As such, the termination sequence of the image forming operation is determined to be performed after an image is formed on the nth page. That is, upon completing the exposure at the black (K) station for the nth page, the image forming apparatus terminates the image forming operation.

The temperature rise upper limit L is 5° C. in the comparison example and the present embodiment. Since the image information corresponding to the (n+1)th to (n+4)th pages is not acquired, the fixable temperatures $Tb_{n+1}$ to $Tb_{n+4}$ in the comparison example are the reference fixable temperature Ts. In the comparison example, since the fixable temperatures $Tb_{n+1}$ to $Tb_{n+4}$=Ts (reference fixable temperature), $T_n$=Ts−5° C. as shown in FIG. 13A. In the present embodiment, the image information of the (n+1)th to (n+4) th pages is not acquired, but the image forming operation terminates after the image for the nth page is formed. In the present embodiment, since the fixable temperatures $Tb_{n+1}$ to $Tb_{n+4}$ are Ts−50° C. (the minimum temperature in monochrome mode), $T_n$ is Ts−50° C. as shown in FIG. 13B.

As for the situations in which the acquirement of image information restarts after some delay in extracting or transmitting image information, or another print job starts after the termination of an image forming operation is determined, the descriptions in the second embodiment are applicable to the present embodiment.

The image forming apparatus set to the color mode uses color toner to form a toner image on the recording medium 11. The image forming apparatus set to the monochrome mode uses black toner to form a toner image on the recording medium 11. Black toner has a lower melting temperature than color toner. For this reason, in the present embodiment, $Tb_n$=Ts−50° C. when the image type is character image (image type information $I_n$=1), and $Tb_n$=Ts−40° C. when the image type is solid image (image type information $I_n$=2). In the first and second embodiments, $Tb_n$=Ts−40° C. when the image type is character image (image type information $I_n$=1). In the first and second embodiments, $Tb_n$=Ts−30° C. when the image type is solid image (image type information $I_n$=2). The present embodiment allows $Tb_n$ set when the image type is character image (=Ts−50° C.) to be less than the $Tb_n$ set when the image type is character image in the first and second embodiments (=Ts−40° C.). The present embodiment also allows the $Tb_n$ set when the image type is solid image (=Ts−40° C.) to be less than the $Tb_n$ set when the image type is solid image in the first and second embodiments (=Ts−30° C.). This achieves appropriate setting of the target temperature $T_n$ according to the mode in which the image forming apparatus is operating. Additionally, the target temperature $T_n$ is further lowered, reducing the power consumption of the image forming apparatus.

Examples of processes performed by the image analysis portion 401 and the target temperature control portion 350 in the present embodiment are described below. The target temperature control portion 350 may perform a part or all of the processes performed by the image analysis portion 401, or the image analysis portion 401 may perform a part or all of the processes performed by the target temperature control portion 350. The image analysis portion 401 acquires image information and the operation information of the image forming apparatus. In the examples described below, the image analysis portion 401 acquires the image information corresponding to at least one first page, but fails to acquire the image information corresponding to at least one second page following the first page. In the example in FIG. 13B, the nth page is a first page, and the (n+1)th to (n+4)th pages are second pages. The operation information of the image forming apparatus may be setting information of the image forming mode, for example. The operation information of the image forming apparatus may include color mode setting information or monochrome mode setting information.

When the operation information of the image forming apparatus includes the color mode setting information and the information on a termination of the operation of the image forming portion, the target temperature control portion 350 sets a first upper limit and a first lower limit of the first temperature, and set the second temperature to a first value.

Since the setting range (temperature range) of fixable temperatures Tb in the color mode is Ts to Ts−40° C., the target temperature control portion 350 sets a first upper limit (Ts) of the first temperature, and sets a first lower limit (Ts−40° C.) of the first temperature. When the image forming apparatus is operating in the color mode and the image forming apparatus terminates the image forming operation, the fixable temperature for a page for which image information is not acquired is the minimum temperature of the color mode (Ts−40° C.). The target temperature control portion 350 therefore sets the second temperature to a first value (Ts−40° C.).

The target temperature control portion 350 thus sets the first lower limit (Ts−40° C.) of the first temperature and sets the second temperature to the first value (Ts−40° C.). The first lower limit (Ts−40° C.) of the first temperature is therefore equal to the first value (Ts−40° C.).

When the operation information of the image forming apparatus includes the monochrome mode setting information and the information on a termination of the operation of the image forming portion, the target temperature control portion 350 sets a second upper limit and a second lower limit of the first temperature, and set the second temperature to a second value.

Since the setting range (temperature range) of fixable temperatures Tb in the monochrome mode is Ts−40° C. to Ts−50° C., the target temperature control portion 350 sets a second upper limit (Ts−40° C.) of the first temperature, and sets a second lower limit (Ts−50° C.) of the first temperature. When the image forming apparatus is operating in the monochrome mode and the image forming apparatus terminates the image forming operation, the fixable temperature for a page for which image information is not acquired is the minimum temperature in the monochrome mode (Ts−50° C.). The target temperature control portion 350 therefore sets the second temperature to a second value (Ts−50° C.).

The target temperature control portion 350 thus sets the second lower limit (Ts−50° C.) of the first temperature and sets the second temperature to the second value (Ts−50° C.). The second lower limit (Ts−50° C.) of the first temperature is therefore equal to the second value (Ts−50° C.). The second upper limit (Ts−40° C.) of the first temperature is less than the first upper limit (Ts) of the first temperature, and the second value (Ts−50° C.) is less than the first value (Ts−40° C.). Further, the second lower limit (Ts−50° C.) of the first temperature is less than the first lower limit (Ts−40° C.) of the first temperature.

The first to third embodiments use the image density information $D_n$ and image type information L to calculate a fixable temperature for each page, but other methods may be used to calculate fixable temperatures.

The first to third embodiments are described with reference to a configuration of a color image forming apparatus, but a configuration of a monochrome image forming apparatus may also be used.

The method of the second embodiment used to set fixable temperatures for pages subsequent to a termination or suspension of the image forming operation when the image forming apparatus determines to terminate or suspend is also applicable to a monochrome image forming apparatus.

The image forming modes include the color mode and the monochrome mode in the examples described above. However, the image forming modes may include other modes. For example, the image forming modes may include a normal mode that does not limit the toner amount (first image forming mode) and an economy mode that limits the toner amount and allows toner images to be fixed at a lower temperature (second image forming mode). The image forming apparatus performs the same processes as the color mode when the normal mode is set, and performs the same processes as the monochrome mode when the economy mode is set.

The embodiments described above use a ceramic heater as the heater 63, but a different heating configuration, such as a halogen heater or induction heating (IH), may be used as the heater 63.

In the embodiments described above, the image forming apparatus is connected to the host computer 300 for printing. However, instead of the host computer 300, the image forming apparatus may be connected to a computer or a print server on a network for printing.

The image processing portion 303 performs the processes of analyzing images and calculating correction amounts of target temperatures. The present disclosure is not limited to this configuration, and programs stored in the host computer 300, and a printer and a print server on a network may perform a part or all of the processes of analyzing images and calculating correction amounts of target temperatures.

Target temperatures may be changed based on fixing mode information, environment information detected by environment detecting means (not shown), and information on the type of the recording medium detected by a media sensor (not shown). The fixing control sets or changes target temperatures. However, gains and offset power amount in the PID control used for the target temperature control may be changed.

One target temperature is set for each page, but a target temperature may be set for each of multiple regions in a page. For example, an optimal target temperature may be set for each of multiple regions in the conveying direction, which may correspond to the fixing film cycle. This allows for changing the target temperature for each of multiple regions in a page. Additionally, setting an appropriate target temperature for each of multiple regions arranged in the main scanning direction may be useful for the control of heaters separated in the longitudinal direction.

In each embodiment, target temperatures may be set by calculating a correction value for the reference target temperature and correcting the reference target temperature with the correction value. Instead of a correction value, a value that correlates with target temperatures may be used, or another value that correlates with the fixing performance may be used.

Each embodiment may be configured to be able to select whether a fixable temperature is set for a page based on the operation information (operating condition) of the image forming apparatus. This allows the user to choose whether to prioritize energy saving or productivity.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2019-238505, filed on Dec. 27, 2019, which is hereby incorporated by reference herein in its entirety.

What is claimed is:

1. An image forming apparatus comprising:

an acquiring portion configured to acquire image information and operation information of the image forming apparatus;

an image forming portion configured to form a toner image on a recording material;

a fixing portion configured to fix the toner image to the recording material by heating the recording material on which the toner image is formed; and a control portion configured to, in a case the acquiring portion acquires image information corresponding to a first page and fails to acquire image information corresponding to a second page following the first page, set a temperature of the fixing portion for fixing the first page as a first temperature based on the image information corresponding to the first page and the operation information, and set the temperature of the fixing portion for fixing the second page as a second temperature based on the operation information.

2. The image forming apparatus according to claim 1, wherein the control portion is configured to set a first target temperature for maintaining the temperature of the fixing portion for the first page based on the first temperature and the second temperature, and control electric power supplied to the fixing portion such that the temperature of the fixing portion for fixing the toner image to the recording material is maintained at the first target temperature.

3. The image forming apparatus according to claim 2, wherein a temperature difference between the first target temperature set for the first page and the second temperature is less than or equal to a predetermined value.

4. The image forming apparatus according to claim 2, wherein the first page is one of n first pages, n being an integer of at least 2, a temperature difference between the first target temperature set for one of two successive first pages in the n first pages and the first target temperature set for the other of the two successive first pages is less than or equal to a predetermined value, and a temperature difference between the first target temperature set for a last one of the n first pages and the second temperature is less than or equal to the predetermined value.

5. The image forming apparatus according to claim 1, wherein the control portion is configured to, when the acquiring portion acquires the image information corresponding to the first page and the image information corresponding to the second page, set the temperature of the fixing portion for fixing the first page as a third temperature based on the image information corresponding to the first page and the operation information, and set the temperature of the fixing portion for fixing the second page as a fourth temperature based on the image information corresponding to the second page and the operation information.

6. The image forming apparatus according to claim 5, wherein the control portion is configured to set a second target temperature for maintaining the temperature of the fixing portion for the first page based on the third temperature and the fourth temperature, and control electric power supplied to the fixing portion such that the temperature of the fixing portion for fixing the toner image to the recording material is maintained at the second target temperature.

7. The image forming apparatus according to claim 1, wherein the operation information includes information on a first image forming mode relating to image forming operation of the image forming apparatus and information on a second image forming mode relating to the image forming operation of the image forming apparatus.

8. The image forming apparatus according to claim 7, wherein the control portion is configured to when the operation information includes the information on the first image forming mode, set a first upper limit and a first lower limit of the first temperature and set the second temperature to a first value, and when the operation information includes the information on the second image forming mode, set a second upper limit and a second lower limit of the first temperature and set the second temperature to a second value, the first upper limit is equal to the first value, and the second upper limit is equal to the second value.

9. The image forming apparatus according to claim 8, wherein the second upper limit is less than the first upper limit, and the second value is less than the first value.

10. The image forming apparatus according to claim 8, wherein the first lower limit is equal to the second lower limit.

11. The image forming apparatus according to claim 8, wherein the second lower limit is less than the first lower limit.

12. The image forming apparatus according to claim 7, wherein the control portion is configured to when the operation information includes the information on the first image forming mode and information on a termination of the operation of the image forming portion, set a first upper limit and a first lower limit of the first temperature and set the second temperature to a first value, and when the operation information includes the information on the second image forming mode and the information on the termination of the operation of the image forming portion, set a second upper limit and a second lower limit of the first temperature and set the second temperature to a second value, the first lower limit is equal to the first value, and the second lower limit is equal to the second value.

13. The image forming apparatus according to claim 12, wherein the second upper limit is less than the first upper limit, and the first value is equal to the second value.

14. The image forming apparatus according to claim 12, wherein the second upper limit is less than the first upper limit, and the second value is less than the first value.

15. The image forming apparatus according to claim 7, wherein the first image forming mode is a mode for forming a color toner image on the recording material, and the second image forming mode is a mode for forming a monochrome toner image on the recording material.

16. An image-forming method of an image forming apparatus including an image forming portion that forms a toner image on a recording material and a fixing portion that fixes the toner image to the recording material by heating the recording material on which the toner image is formed, the image-forming method causing a computer to execute:

a step of acquiring image information and operation information of the image forming apparatus; and a step of setting, when image information corresponding to a first page is acquired and image information corresponding to a second page following the first page is not acquired, a temperature of the fixing portion for fixing the first page as a first temperature based on the image information corresponding to the first page and the operation information, and setting the temperature of the fixing portion for fixing the second page as a second temperature based on the operation information.

17. A non-transitory storage medium storing a computer-readable program causing a computer to perform an image-forming method of an image forming apparatus including an image forming portion that forms a toner image on a recording material and a fixing portion that fixes the toner image to the recording material by heating the recording material on which the toner image is formed, the program causing the computer to execute:

a step of acquiring image information and operation information of the image forming apparatus; and a step of setting, when image information corresponding to a first page is acquired and image information corresponding to a second page following the first page is not acquired, a temperature of the fixing portion for fixing the first page as a first temperature based on the image information corresponding to the first page and the operation information, and setting the temperature of the fixing portion for fixing the second page as a second temperature based on the operation information.

* * * * *